US008046942B1

(12) United States Patent
Kludt et al.

(10) Patent No.: US 8,046,942 B1
(45) Date of Patent: Nov. 1, 2011

(54) ELECTRONIC SIGN WITH MULTIPLE DIRECTION POSITIONABLE REAR ACCESS DOORS

(75) Inventors: Kory D. Kludt, Brookings, SD (US); Jonathan Tremblay, St-Roch de l'Achigan (CA)

(73) Assignee: Daktronics, Inc., Brookings, SD (US)

( * ) Notice: Subject to any disclaimer, the term of this patent is extended or adjusted under 35 U.S.C. 154(b) by 773 days.

(21) Appl. No.: 11/529,065

(22) Filed: Sep. 28, 2006

(51) Int. Cl.
*G09F 13/00* (2006.01)

(52) U.S. Cl. ..... 40/541; 40/549; 312/199; 312/349; 49/127; 49/130

(58) Field of Classification Search ..... 40/541, 40/549; 312/199, 349; 49/127, 130, 209, 49/404

See application file for complete search history.

(56) References Cited

U.S. PATENT DOCUMENTS

| | | | | | |
|---|---|---|---|---|---|
| 1,673,962 | A * | 6/1928 | Wiley | 40/549 |
| 3,390,259 | A * | 6/1968 | Angier | 40/549 |
| 5,665,938 | A * | 9/1997 | Boshear et al. | 174/50 |
| 5,718,083 | A * | 2/1998 | Dowdell, II | 49/407 |
| 5,983,543 | A * | 11/1999 | Hillstrom | 40/574 |
| 6,094,934 | A * | 8/2000 | Rand et al. | 62/440 |
| 6,589,308 | B1 * | 7/2003 | Gianelo | 55/385.6 |
| 6,926,375 | B2 * | 8/2005 | Nagamine et al. | 312/111 |
| 7,849,633 | B2 * | 12/2010 | Oshima et al. | 49/209 |
| 2008/0163526 | A1 * | 7/2008 | Campoy Odena | 40/541 |

* cited by examiner

*Primary Examiner* — Gary Hoge
(74) *Attorney, Agent, or Firm* — Schwegman, Lundberg & Woessner, P.A.

(57) ABSTRACT

An electronic sign with multiple direction positionable rear access doors, wherein sliding rear access doors are utilized to provide for access to the inner regions of the electronic sign while maintaining a thin profile. One or more of a plurality of sliding rear access doors can be disengaged from a back panel and urged rearwardly a minimal distance and then positioned laterally and unobtrusively along the length of a top track opposing a bottom track allowing the electronic sign to maintain a thin and unobtrusive profile.

30 Claims, 20 Drawing Sheets

ELECTRONIC SIGN WITH MULTIPLE DIRECTION POSITIONABLE REAR ACCESS DOORS

CROSS REFERENCES TO RELATED APPLICATIONS

This patent application is related to patent application Ser. No. 11/227,599 filed Sep. 15, 2005, entitled "Electronic Display Panel", pending, which is a continuation-in-part (CIP) of patent application Ser. No. 11/148,461 filed Jun. 9, 2005, entitled "Sign System", pending, both applications by the same assignee.

BACKGROUND OF THE INVENTION

1. Field of the Invention

The present invention relates to an electronic sign, and more specifically relates to an electronic sign with access doors which are positionable in multiple directions at the rear of an electronic sign structure.

2. Description of the Prior Art

Prior art electronic signs often are supported with support components which are incorporated to lend support to the structure of an electronic sign. Often, the components of the support structure are fashioned to allow access to the rear portion of the electronic sign for the purpose of maintenance or equipment changeout and must be structured to allow opening of rearwardly located access panels or doors which can be hinged and which open outwardly. As such, the structure may be extraordinarily cumbersome or may be constructed larger than practical to accommodate such access, such as by providing sufficient space for the opening of hinged doors or panels. Support structure may be fashioned in a manner which can limit or prohibit opening of some access doors or panels or which may require partial disassembly of the support structure. Operation of large access doors in windy conditions can be difficult and can be hazardous to personnel where a door can be caught by the wind and propelled out of control into a maintenance worker. What is needed is an electronic sign having a thin profile for all modes of operation, including a rear access panel arrangement which allows for controlled and unobstructed access to the inner, rear and other portions of an electronic sign, whereby the access panels may be unobstructingly actuated and maneuvered in multiple directions without interference by adjacent support structure.

SUMMARY OF THE INVENTION

The general purpose of the present invention is to provide an electronic sign with multiple direction positionable rear access doors.

According to one embodiment of the present invention, there is provided an electronic sign with multiple direction positionable rear access doors slidingly mounted between and positionable along a top track and an opposed bottom track. A plurality of lock mechanisms located along and about the perimeters of the plurality of rear access doors engage a plurality of mounting rails to secure the pluralities of rear access doors against a plurality of seals which surround a plurality of access openings in the rear panel of the electronic sign structure. Access to the inner electronic components of the electronic sign is gained by unlocking the lock mechanisms, positioning the rear access doors rearwardly within the opposed top track and bottom track followed by lateral transitioning of the rear access doors to reveal the interior of the electronic sign structure, thereby allowing unrestricted access therein. Sealing of the rear access doors is accomplished in the reverse order.

According to an alternative embodiment of the present invention, there is provided an electronic sign with multiple direction positionable rear access doors including a plurality of rear access doors having a roller support track for rear access door suspension.

One significant aspect and feature of the electronic sign with multiple direction positionable rear access doors, the present invention, is the ability to incorporate the present invention with minimally dimensioned external rear support structure, whereby no room must be included for outward swinging of prior art hinge mounted doors.

Another significant aspect and feature of the present invention is the ability to access the interior of the electronic sign through non-hinged multiple direction positionable rear access doors.

Another significant aspect and feature of the present invention is the use of a bottom track and a top track.

Still another significant aspect and feature of the present invention is the use of rear access doors slidably mounted between a bottom track and a top track.

Yet another significant aspect and feature of the present invention is the use of mounting rails incorporated at access openings to interface with lock mechanisms located on the rear access doors.

Yet another significant aspect and feature of the present invention is an electronic sign with multiple direction positionable rear access doors, whereby multiple direction positionable rear access doors which are slidable are utilized to provide for access to the inner regions of the electronic sign while maintaining a thin profile.

Another significant aspect and feature of the present invention appears in an alternative embodiment and is a roller support track allowing forward or rearward movement of a rear access door.

Another significant aspect and feature appearing in the alternative embodiment of the present invention is that the roller support track also allows lateral movement of a rear access door.

Another significant aspect and feature appearing in the alternative embodiment of the present invention is the use of a top track roller support and a multiple slot roller support to form an elongated slot.

Another significant aspect and feature appearing in the alternative embodiment of the present invention is the use of rear access doors which, because of door suspension, are easily operable.

Having thus briefly described embodiments of the present invention and having mentioned some significant aspects and features of the present invention, it is the principal object of the present invention to provide an electronic sign with multiple direction positionable rear access doors.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
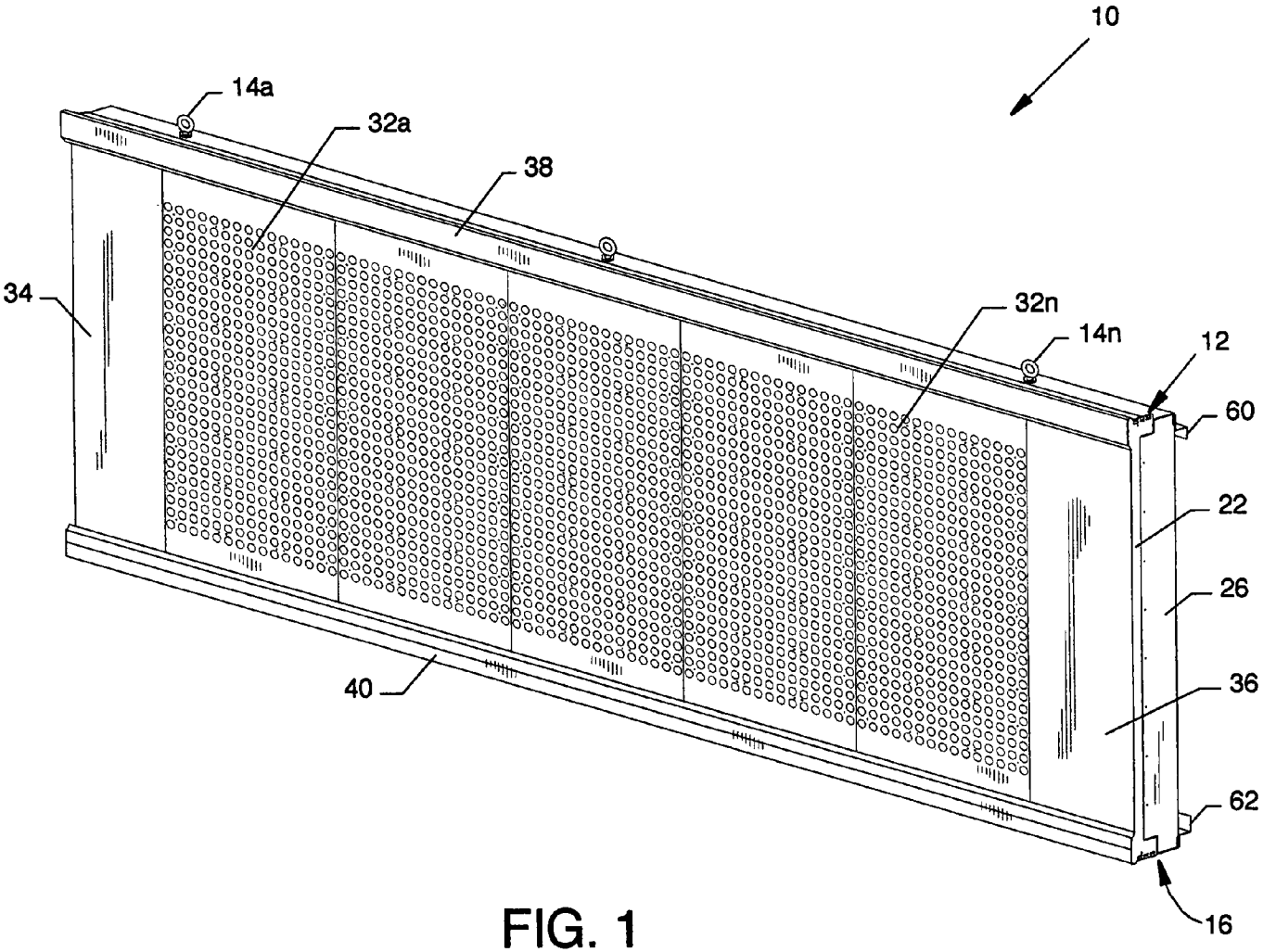
FIG. 1 is an isometric view of the front of an electronic sign with multiple direction positionable rear access doors, the present invention.
Figure 2:
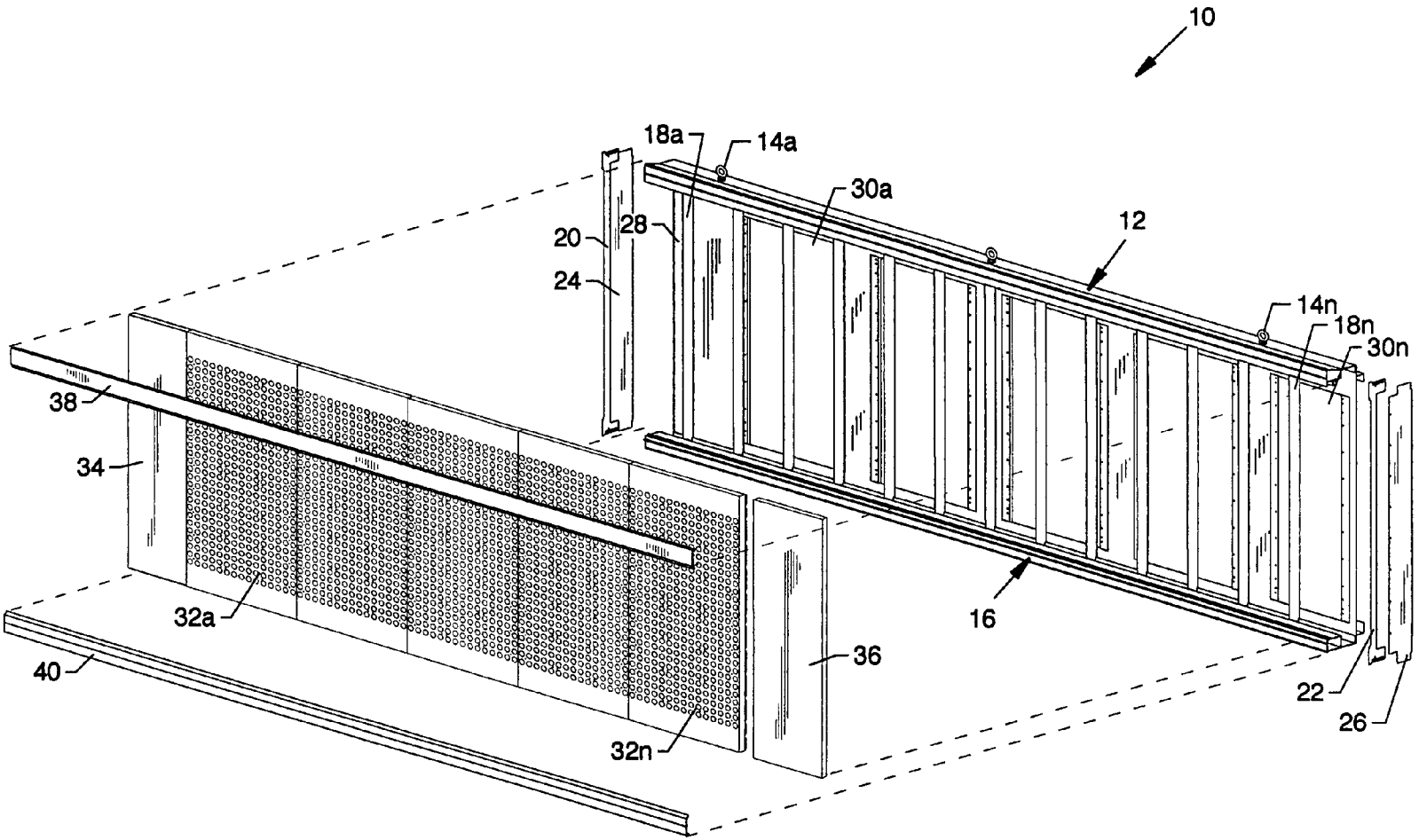
FIG. 2 is an exploded view of the front of an electronic sign with multiple direction positionable rear access doors showing the forwardly utilized components thereof.

FIG. 1 is an isometric view of the front of an electronic sign with multiple direction positionable rear access doors 10, the present invention, and FIG. 2 is an exploded view of the front of an electronic sign with multiple direction positionable rear access doors 10 showing the forwardly utilized components thereof. As shown in one or both of FIGS. 1 and 2, the forwardly located components of the electronic sign with multiple direction positionable rear access doors 10 include a horizontally aligned geometrically configured top support channel 12 having lifting lugs 14*a*-14*n* and a horizontally aligned geometrically configured bottom support channel 16 opposing the geometrically configured top support channel 12, the structure, attributes and features of which are described in detail in U.S. patent application Ser. No. 11/148,461 filed Jun. 9, 2005, entitled "Sign System". A plurality of vertically aligned internal support channels 18*a*-18*n* secure between the geometrically configured top support channel 12 and the geometrically configured bottom support channel 16. Left and right front end plates 20 and 22, respectively, and left and right back end plates 24 and 26, respectively, secure between the respective ends of the geometrically configured top support channel 12 and the geometrically configured bottom support channel 16. A back panel 28 having access openings 30*a*-30*n* secures and extends between portions of the geometrically configured top support channel 12 and the geometrically configured bottom support channel 16. A plurality of electronic display panels 32*a*-32*n*, the structure, attributes and features of which are described in detail in U.S. patent application Ser. No. 11/227,599 filed Sep. 15, 2005, entitled "Electronic Display Panel", mount between the geometrically configured top support channel 12 and the configured geometrically configured bottom support channel 16 in the fashion of U.S. patent application Ser. No. 11/148,461, as do left face panel 34 and right face panel 36, each having corresponding and suitable geometry. Accordingly, a top shroud 38 and a bottom shroud 40 snappingly engage the geometrically configured top support channel 12 and the geometrically configured bottom support channel 16, as described in U.S. patent application Ser. No. 11/148,461, thereby sealing the front planar regions of the electronic display panels 32*a*-32*n* adjacent to the top and bottom edges thereof, as well as the front planar regions adjacent to the top and bottom edges of the left face panel 34 and right face panel 36.

Figure 3:
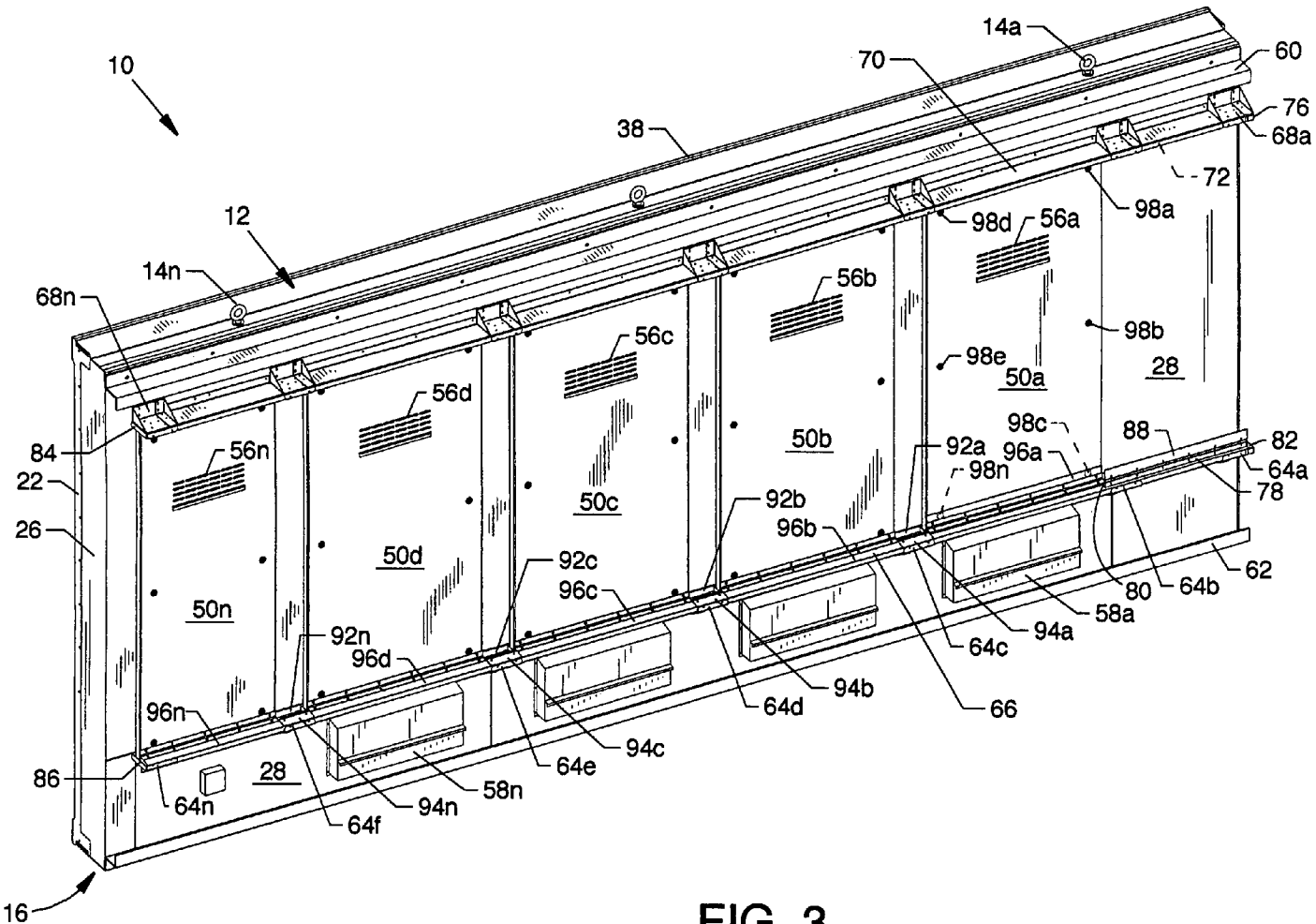
FIG. 3 is an upper aspect isometric rear view of the electronic sign with multiple direction positionable rear access doors.
Figure 4:
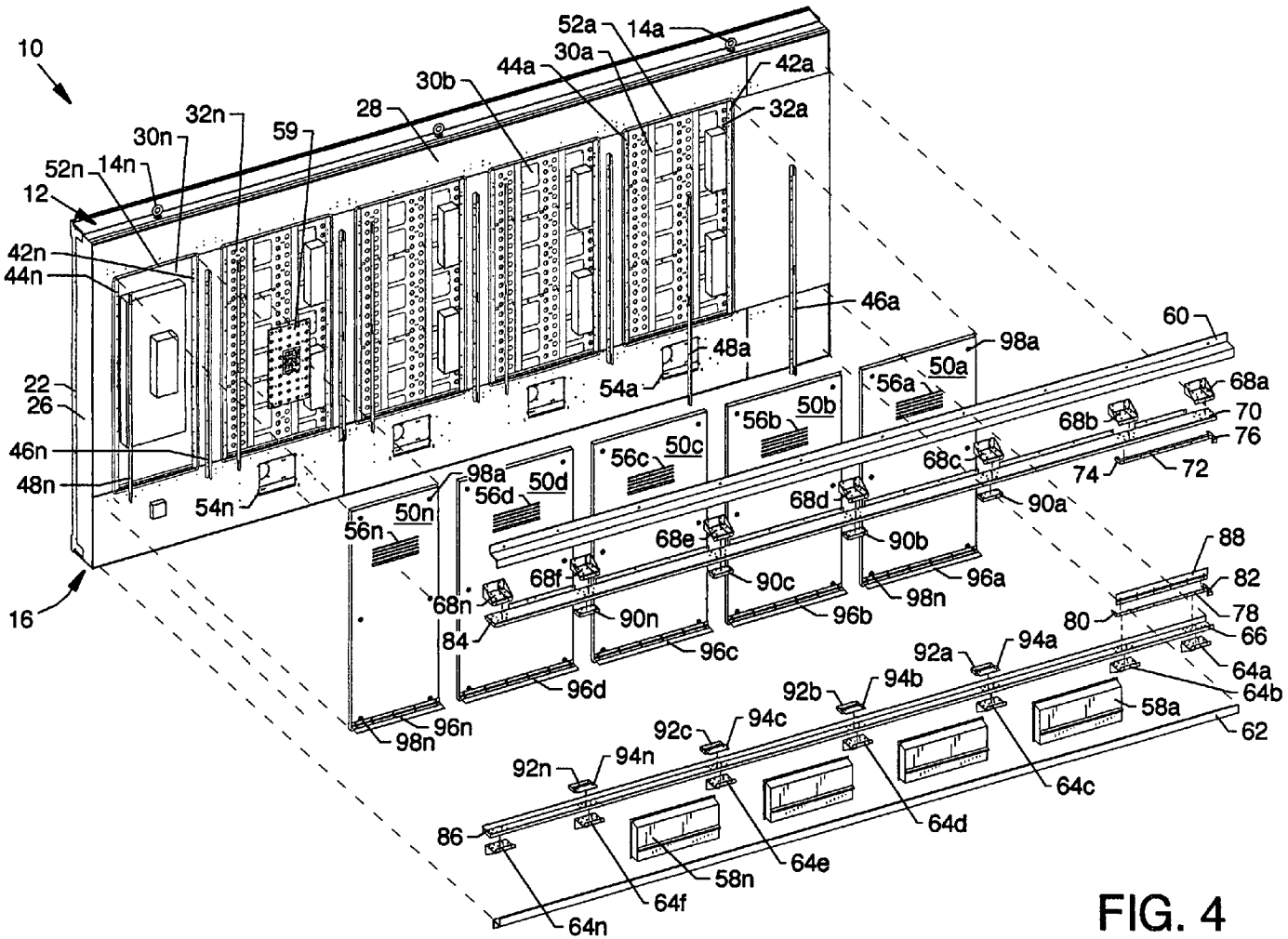
FIG. 4 is an upper aspect isometric exploded rear view of the electronic sign with multiple direction positionable rear access doors.
Figure 5:
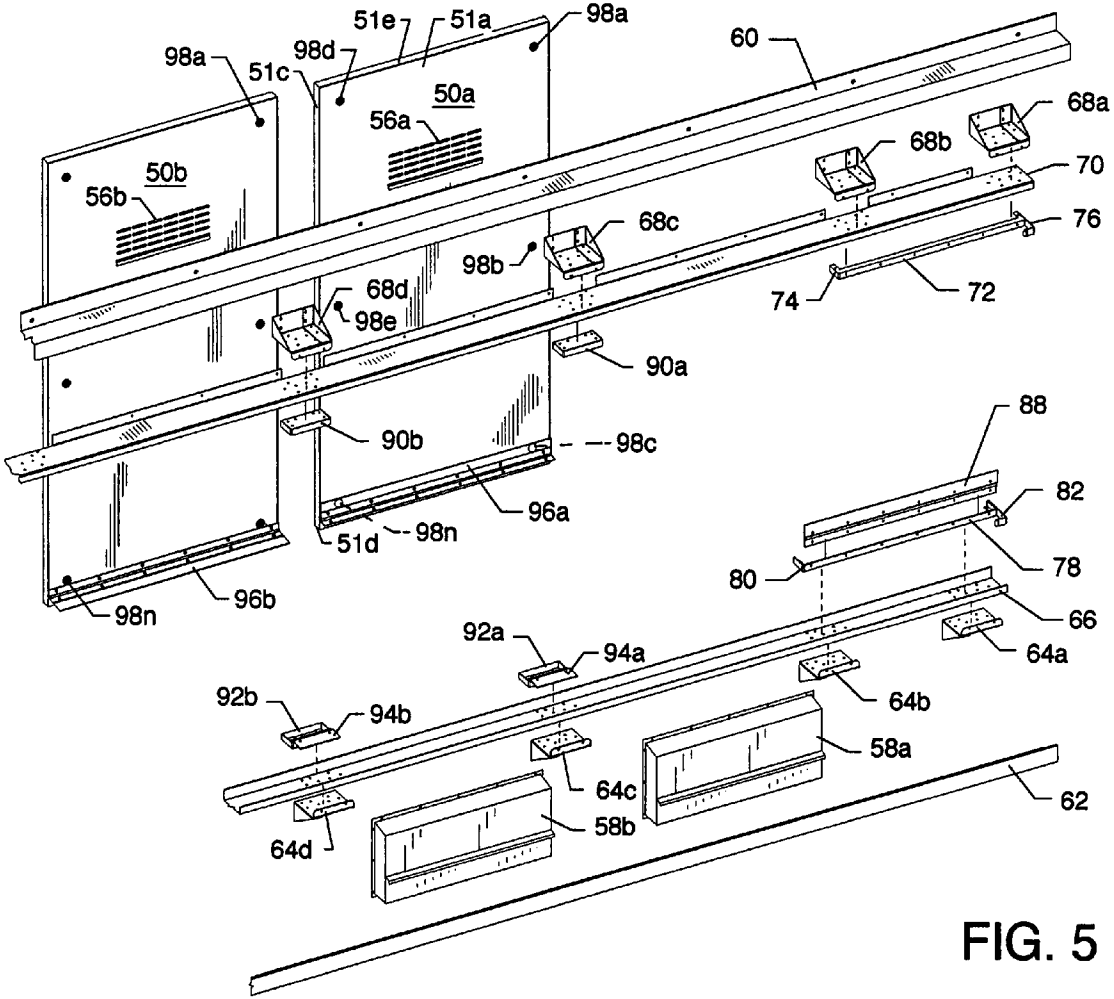
FIG. 5 is a closeup upper aspect isometric exploded rear view of the left end of the electronic sign with multiple direction positionable rear access doors.
Figure 6:
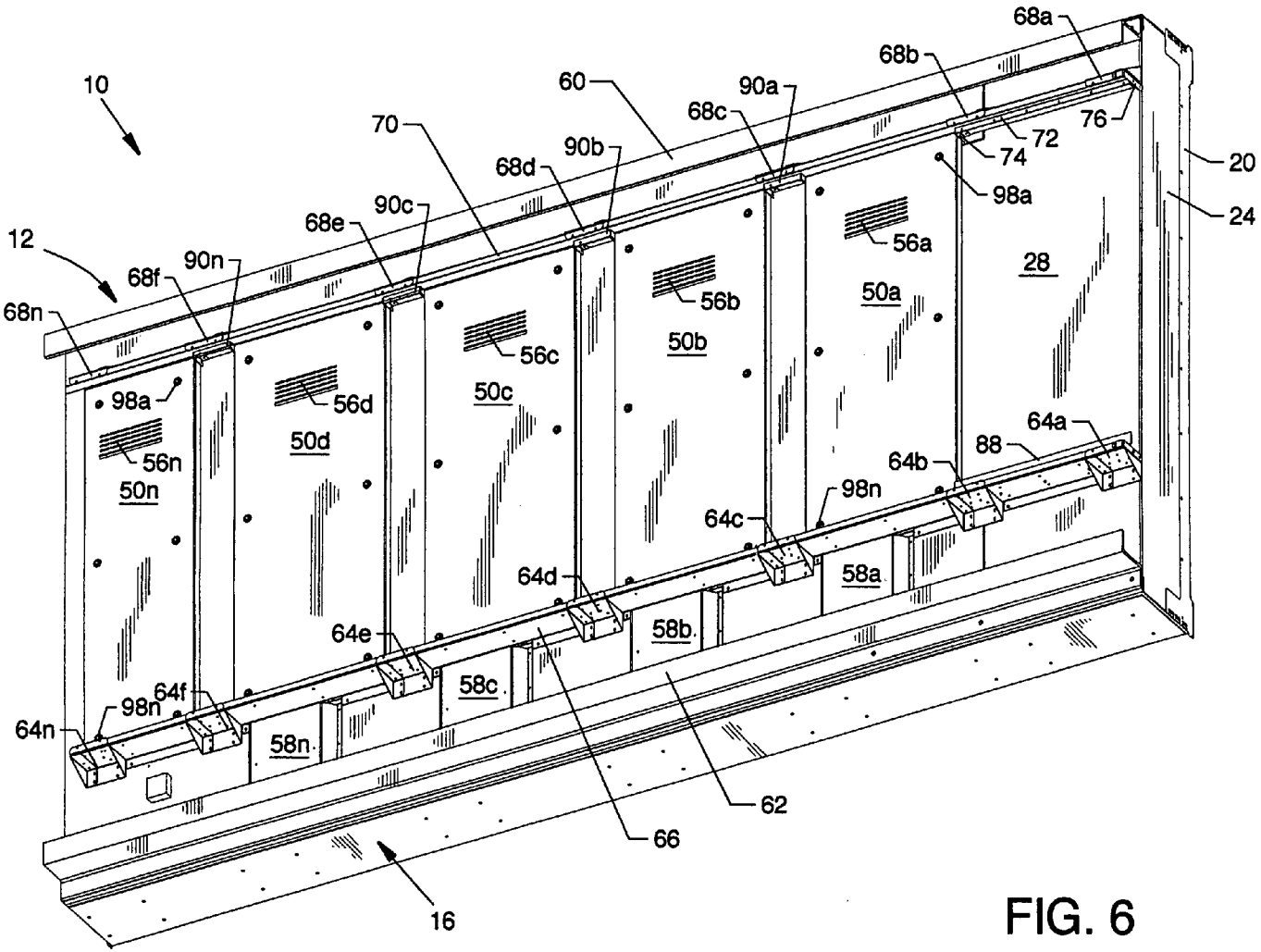
FIG. 6 is a lower aspect isometric rear view of the electronic sign with multiple direction positionable rear access doors.
Figure 7:
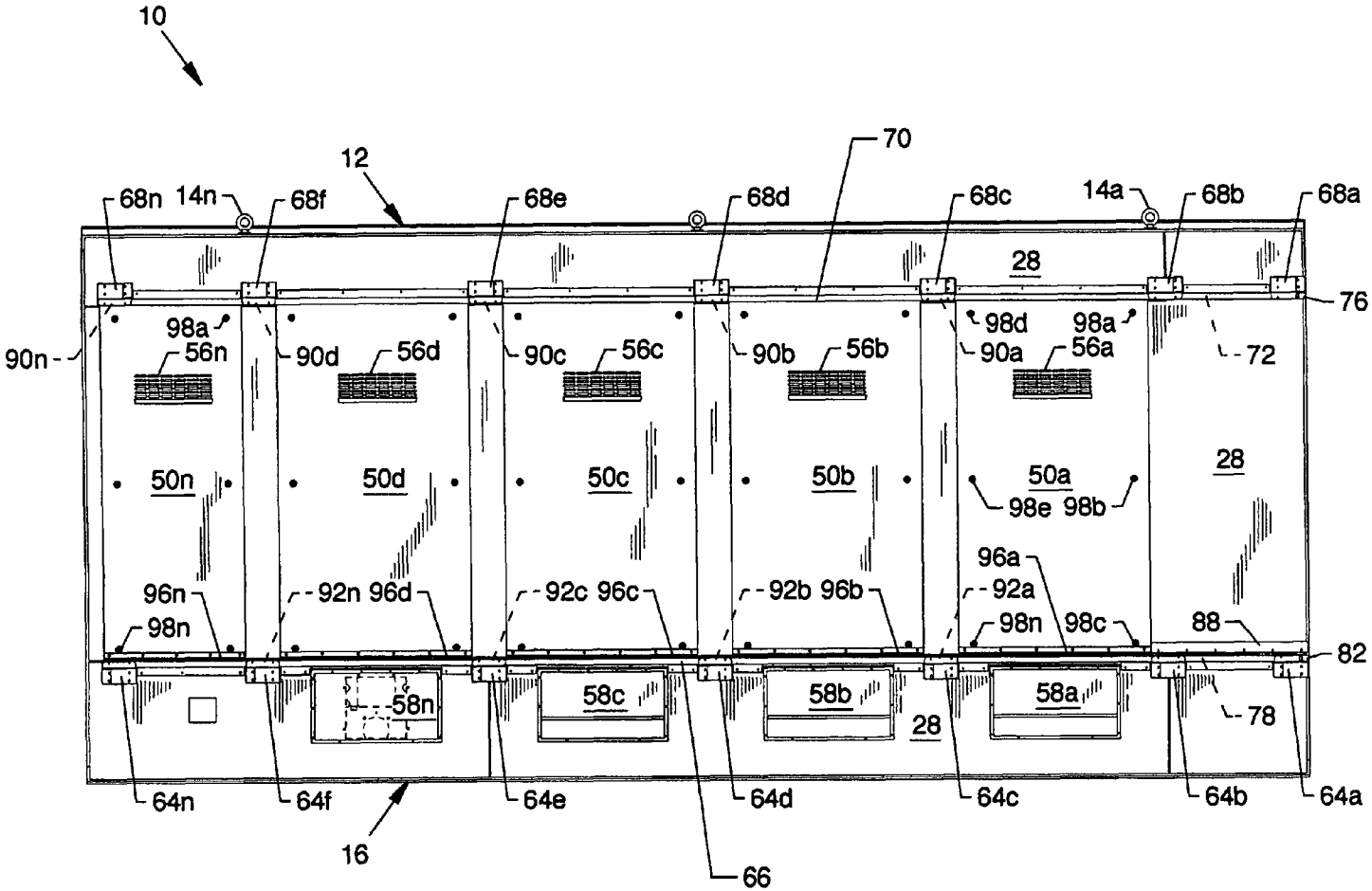
FIG. 7 is a rear view of the electronic sign with multiple direction positionable rear access doors.

FIG. 3 is an upper aspect isometric rear view of the electronic sign with multiple direction positionable rear access doors 10, FIG. 4 is an upper aspect isometric exploded rear view of the electronic sign with multiple direction positionable rear access doors 10, FIG. 5 is a closeup upper aspect isometric exploded rear view of the left end of the electronic sign with multiple direction positionable rear access doors 10, FIG. 6 is a lower aspect isometric rear view of the electronic sign with multiple direction positionable rear access doors 10, and FIG. 7 is a rear view of the electronic sign with multiple direction positionable rear access doors 10. With reference to FIGS. 3, 4, 5, 6 and 7, the instant invention is further described. The back panel 28 mounts and extends between the geometrically configured top support channel 12 and the geometrically configured bottom support channel 16 to serve as a mount for numerous components and for the location of features of the instant invention. The vertically aligned edges of the access openings 30*a*-30*n* include a plurality of vertically oriented mounting plates 42*a*-42*n* and an opposed plurality of vertically oriented mounting plates 44*a*-44*n* for accommodation of a plurality of vertically oriented mounting rails 46*a*-46*n* and an opposed plurality of vertically oriented mounting rails 48*a*-48*n*, respectively. The mounting rails 46*a*-46*n* and 48*a*-48*n* are utilized for fastening of a plurality of rear access doors 50*a*-50*n* thereto, as later described in detail. A plurality of suitable seals 52*a*-52*n* secure around and about vertically and horizontally oriented edges of the plurality of access openings 30*a*-30*n* including the mounting rails 46*a*-46*n* and 48*a*-48*n* for the purpose of sealing the plurality of rear access doors 50*a*-50*n* to the back panel 28. A plurality of vent openings 54*a*-54*n* are included at the lower region of the back plate 28 for the flow of cooling air in conjunction with a plurality of cooling fans (not shown), and a plurality of vents 56*a*-56*n* are located in the upper region of each of the plurality of rear access doors 50*a*-50*n*. A plurality of vent covers 58*a*-58*n* secure to the back plate 28 over and about the vent openings 54*a*-54*n*. One LED module 59, the structure, attributes and features of which are described in detail in U.S. patent application Ser. No. 11/227,599, is shown for use as part of each of the electronic display panels 32*a*-32*n*. Only one of a plurality of LED modules 59 is shown for the purpose of brevity and clarity. A top Z-channel 60 and a bottom Z-channel 62 are secured to the upper and lower portions of the back panel 28 to be utilized for connection to external support structure at a sign site.

Structure is provided for sliding support of the rear access doors 50*a*-50*n*. A plurality of support brackets 64*a*-64*n* secure to the back panel 28 just below the lower edge of the access openings 30*a*-30*n* and accommodate fastening of a bottom track 66, preferably of channel construction, to the top thereof. The top of the bottom track 66 is open for the purpose of slidingly accommodating the lower edge of any of the plurality of rear access doors 50*a*-50*n*. Correspondingly, a plurality of support brackets 68*a*-68*n*, inverted with respect to the plurality of support brackets 64*a*-64*n*, secure to the back panel 28 just above the upper edge of the access openings 30*a*-30*n* and accommodate fastening of a top track 70, preferably of channel construction, to the bottom thereof. The bottom of top track 70 is open for the purpose of slidingly accommodating the upper edge of any of the plurality of rear access doors 50*a*-50*n*.

Retainer fixtures of several varieties are included in close attached association with and through the top track 70 and with and through the bottom track 66 in close attached association with various support brackets 64*a*-64*n* and 68*a*-68*n*, respectively. The retainer fixtures, in general, incorporate rectangular or other suitably shaped geometrical structure to serve as guides when it is desired to align any rear access door 50*a*-50*n* to one of the access openings 30*a*-30*n* for sealing thereto subsequent to lateral movement of a rear access door 50*a*-50*n* along the bottom track 66 and the top track 70. An elongated top retainer 72 secures directly to the bottom side of one end of the top track 70 and indirectly therethrough at various locations to the support brackets 68*a* and 68*b*. One end of the elongated top retainer 72 includes a retainer surface 74 corresponding partially to the shape of other retainer fixtures, and the other end includes an angled stop bar 76. Correspondingly, an elongated bottom retainer 78 secures directly to the top side of one end of the bottom track 66 and indirectly therethrough at various locations to the support brackets 64*a* and 64*b*. One end of the elongated bottom retainer 72 includes a retainer surface 80 corresponding partially to the shape of other retainer fixtures, and the other end includes an angled stop bar 82. The angled stop bar 76 of the elongated top retainer 72 and the angled stop bar 82 of the elongated bottom retainer 78 are responsible for keeping the rear access doors 50*a*-50*n* contained within one end of the top track 70 and the bottom track 66. Stop bars 84 and 86 at the other end of the top track 70 and bottom track 66, respectively, are responsible for keeping the rear access doors 50*a*-50*n* contained within the other end of the top track 70 and the bottom track 66. A positionable hinged flap 88, generally shown in vertical orientation, attaches to the elongated bottom retainer 78. A plurality of nominally sized longitudinally spaced top retainers 90*a*-90*n* secure to the underside of the top track 70 in alignment with the support brackets 68*c*-68*f* secured to the top side of the top track 70. Correspondingly, a plurality of nominally sized longitudinally spaced bottom retainers 92*a*-92*n* having respective hinged flaps 94*a*-94*n*, shown near horizontal orientation, secure to the top side of the bottom track 66 in alignment with the support brackets 68*c*-68*f* secured to the bottom side of the bottom track 66.

The retainers 72, 78, 90*a*-90*n* and 92*a*-92*n* occupy a portion of the respective bottom track 66 and the top track 70 closest to the back panel 28. The retainers 72, 78, 90*a*-90*n* and 92*a*-92*n*, in general, incorporate rectangular or other suitably shaped geometrical structure to serve as guides, whereby the rear access doors 50*a*-50*n* are forced to align between the retainers 72, 78, 90*a*-90*n* and 92*a*-92*n* or retainer surfaces 74 or 80, and thence to the plurality of access openings 30*a*-30*n* during a locking procedure. During the unlocking procedure, the rear access doors 50*a*-50*n* are maneuvered rearwardly from between the retainers 72, 78, 90*a*-90*n* and 92*a*-92*n* to the unrestricted rearward portion of the bottom track 66 and the top track 70 which is unobstructed by the retainers 72, 78, 90*a*-90*n* and 92*a*-92*n*, whereby lateral movement of the rear access doors 50*a*-50*n* can be accomplished.

For example and for the purpose of illustration (FIG. 7), the vertically aligned pair of retainers 90*b* and 92*b* and the vertically aligned pair of retainers 90*a* and 92*a* accommodatingly retain the rear access door 50*b* therebetween during maneuvering of the rear access door 50*b* toward the opening 30*b* for fastening or during maneuvering of the rear access door 50*b* rearwardly from the access opening 30*b* for the purpose of gaining access to the components located behind the access opening 30*b* after subsequent sliding of the rear access door 50*b* laterally in either direction. Correspondingly, the vertically aligned pair of retainers 90*a* and 92*a* and the vertically aligned pair of retainer surfaces 74 and 80 (FIG. 5) at the ends of the elongated top retainer 72 and the elongated bottom retainer 78 accommodatingly retain the rear access door 50*a* therebetween during maneuvering of the rear access door 50*a* toward the opening 30*a* for fastening or during maneuvering of the rear access door 50*a* rearwardly from the access opening 30*a* for the purpose of gaining access to the components located behind the access opening 30*a* after subsequent sliding of the rear access door 50*a* laterally in either direction.

Hinged flaps 96*a*-96*n* are also included on the rearward facing surface near the lower edge of each rear access door 50*a*-50*n*. The hinged flap 88, the hinged flaps 94*a*-94*n*, and the hinged flaps 96*a*-96*n* are utilized primarily to cover the interior of the bottom track 66 to discourage entry of dirt, water, insects or other foreign or undesirable material. Each of the hinged flaps can be employed, as required, in vertical orientation to allow non-interfered lateral movement of the rear access doors 50*a*-50*n* along the top track 70 and the bottom track 66. Also shown are lock mechanisms 98*a*-98*n* extending through each of the rear access doors 50*a*-50*n* which have suitable hardware to lockingly engage slots located in the mounting rails 46*a*-46*n* and 48*a*-48*n*, as later shown in detail.

Figure 8:
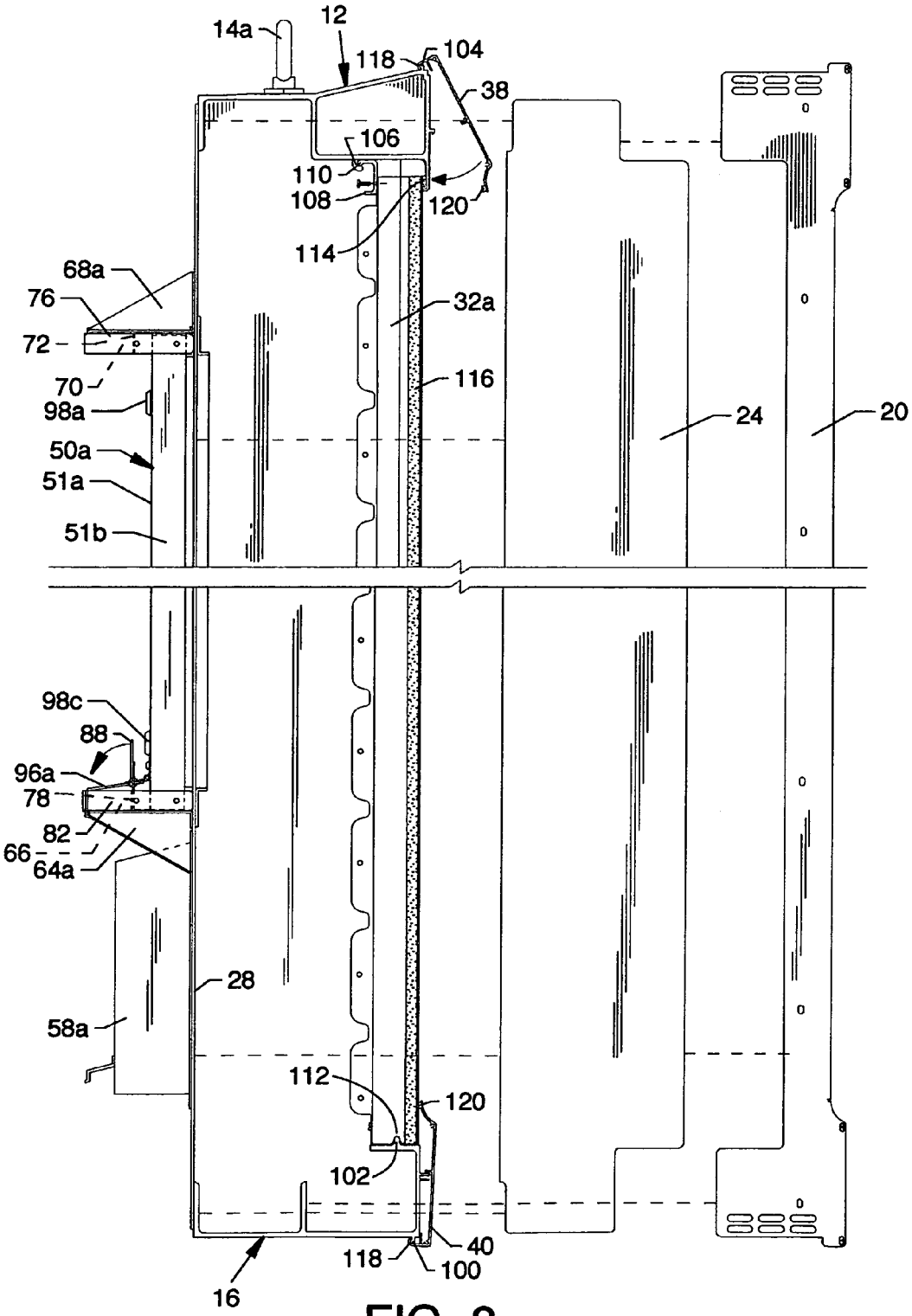
FIG. 8 is a foreshortened right end view of the electronic sign with multiple direction positionable rear access doors.

FIG. 8 is a foreshortened left end view of the electronic sign with multiple direction positionable rear access doors 10, whereby the left front end plate 20 and the left back end plate 24 have been removed from one end of the geometrically configured top support channel 12 and the geometrically configured bottom support channel 16 to show the alignment of the rear access door 50*a* within the top track 70 and the bottom track 66, to show the capture of the electronic display panel 32*a* between the geometrically configured top channel 12 and the geometrically configured bottom channel 16, and to show the sealing scheme of the top shroud 38 and the bottom shroud 40.

The hinged flap 96*a* is shown in the deployed mode to extend from the lower region of the rear access door 50*a* to contact a rearwardly located lip of the bottom track 66. The hinged flap 88, which is connected to the elongated retainer 78, is shown in the vertical position, but may also be positioned in the same fashion as the hinged flap 96*a* to cover the bottom track 66.

The geometrically configured top support channel 12 and the geometrically configured bottom support channel 16 are similar in function and essential features, as described in detail in U.S. patent application Ser. No. 11/148,461. The geometrically configured bottom support channel 16 includes similar and related structure, including an arcuate lip 100 at the front and bottom region and a pivot bar 102 having an arcuate surface located on an upper portion thereof. The geometrically configured top support channel 12 includes an arcuate lip 104 at the upper edge and an arcuate receptor 106 on the lower panel thereof. A retainer bar 108 is also included having an arcuate lip 110. The electronic display panel 32*a* includes multiple slots 112 at the lower edges. The electronic display panel 32*a* mounts between the geometrically configured top support channel 12 and the geometrically configured bottom support channel 16 in the following manner. The bottom edge of the electronic display panel 32*a* is maneuvered to cause intimate engagement of the slots 112 with the pivot bar 102 of the geometrically configured bottom support channel 16 and then the top of the electronic display panel 32*a* is positioned to engage a horizontally oriented weatherstrip seal 114 at the rear surface of the front panel of the geometrically configured top support channel 12 and secured thereto by the retainer bar 108, whereby the arcuate lip 110 of the retainer bar 108 engages the arcuate receptor 110 of the geometrically configured top support channel 12. Vertically oriented weatherstrip seals, such as seal 116, are included at the opposed edges of the electronic display panel 32*a*. Additional sealing against the front surface of the electronic display panel 32*a* is offered by similarly constructed top and bottom shrouds 38 and 40, whereby each includes at least an arcuate receptor 118 and a weatherstrip seal 120. The arcuate receptor 118 of the top shroud 38 engages the arcuate lip 104 of the geometrically configured top support channel 12 and is positioned to cause other structure to frictionally engage other structure of the geometrically configured top support channel 12 to cause sealing engagement of the weatherstrip 120 with the upper and forward portion of the electronic display panel 32*a*. The bottom shroud 40 is positioned in a like manner incorporating the respective arcuate receptor 118 in engagement with the arcuate lip 100 of the geometrically configured bottom support channel 16 to cause sealing engagement of the weatherstrip 120 against the lower and forward portion of the electronic display panel 32*a*.

Figure 9:
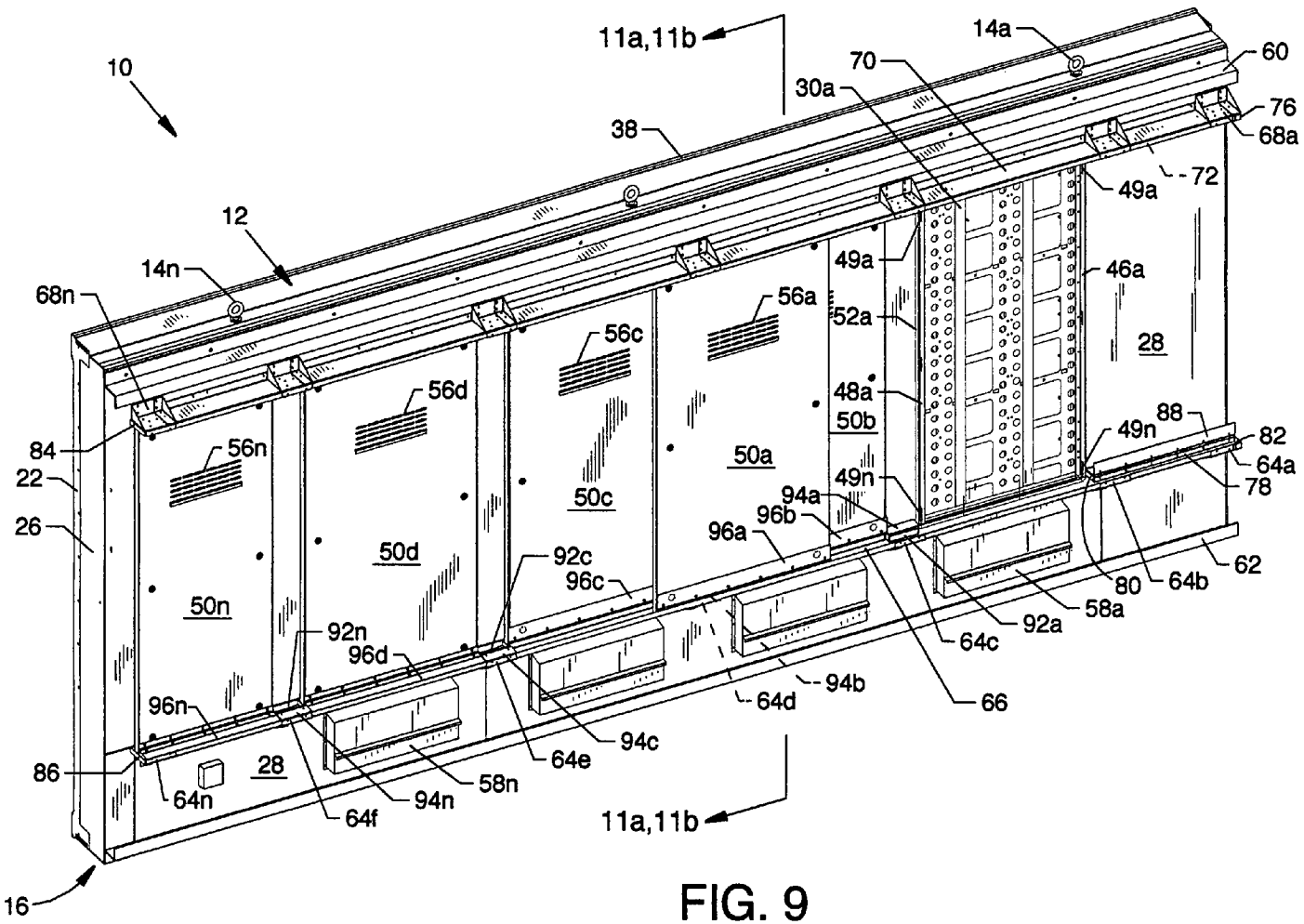
FIG. 9 is an upper aspect isometric rear view of the electronic sign with multiple direction positionable rear access doors showing a rear access door slidingly positioned along and between the engaging bottom track and the top track.
Figure 10:
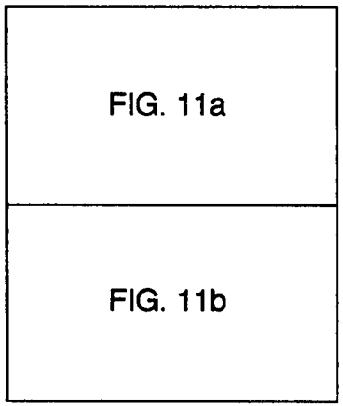
FIG. 10 shows the alignment of FIG. 11*a* with respect to FIG. 11*b;*

FIG. 9 is an upper aspect isometric rear view of the electronic sign with multiple direction positionable rear access doors 10 showing the rear access door 50*a* slidingly positioned along and between the engaging bottom track 66 and the top track 70 distant from the access opening 30*a* and surrounding seal 52*a* to allow access to components through the access opening 30*a*. One or more rear access doors 50*a*-50*n* can be positioned, space allowing, to gain access to other access openings 30*a*-30*n*.

Figure 11A:
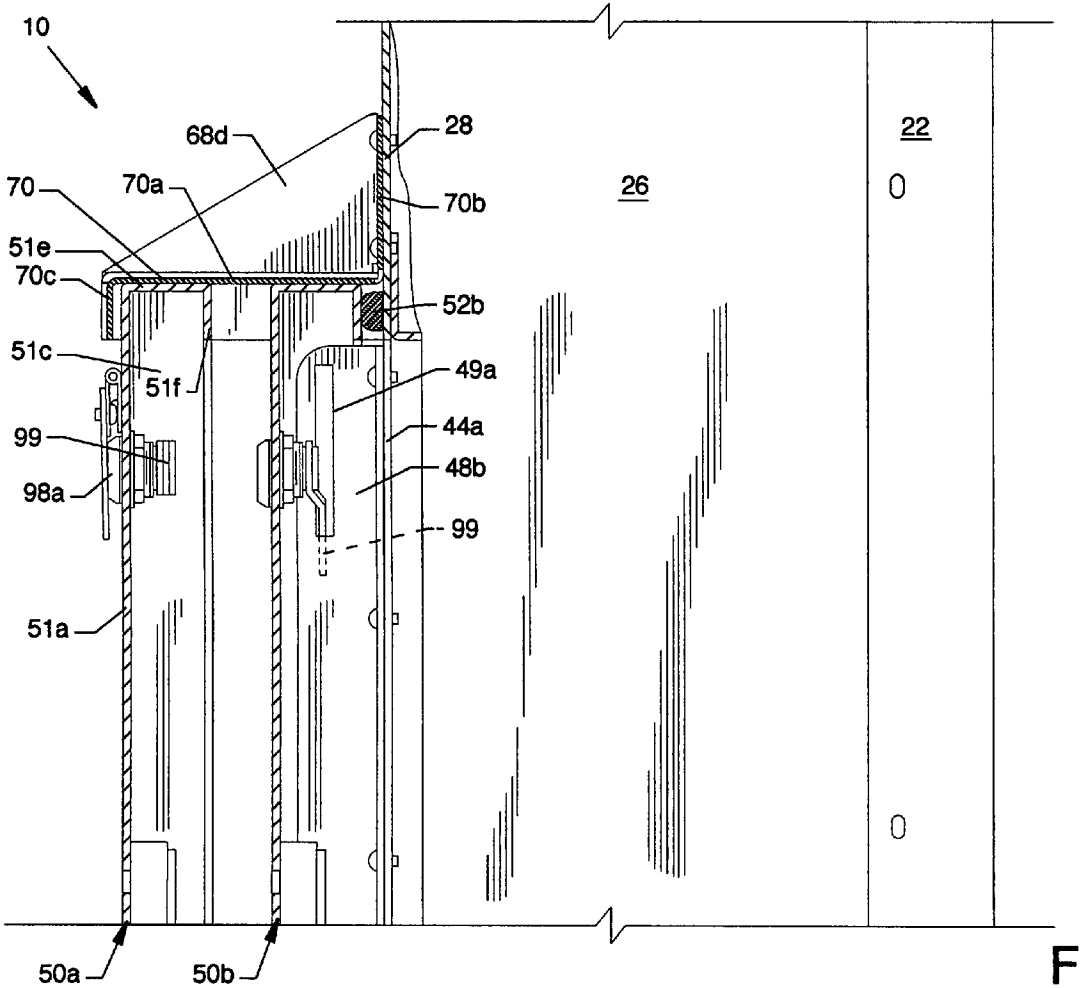
FIGS. 11*a* and 11*b* in combination are a cross section view through line 11*a*, 11*b*-11*a*, 11*b* of FIG. 9 showing other features and components of the rear access doors common to all the rear access doors, and showing other features and components of the bottom track and the top track.
Figure 11B:
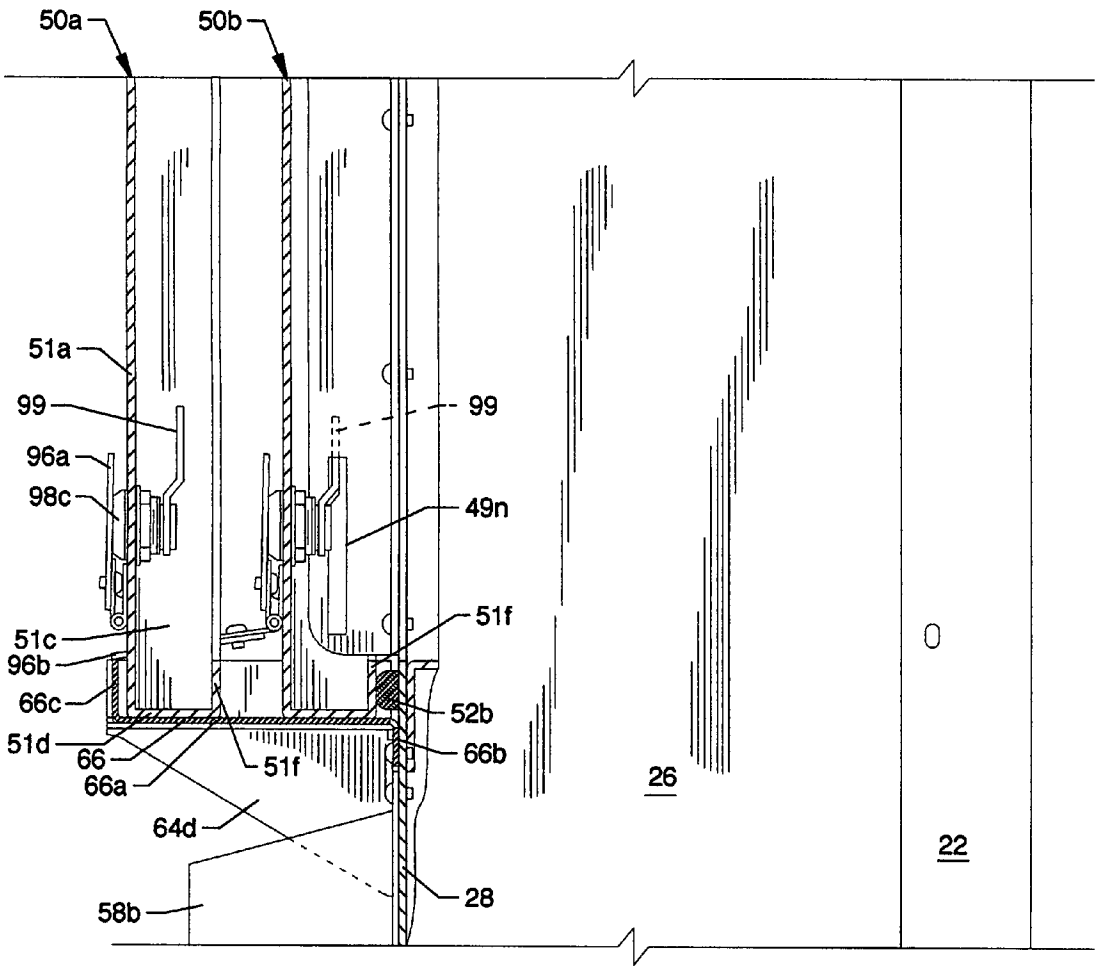

FIGS. 11*a* and 11*b* in combination are a cross section view through line 11*a*, 11*b*-11*a*, 11*b* of FIG. 9 showing other features and components of the rear access doors 50*a* and 50*b* common to each other and to all the rear access doors 50*a*-50*n*, and showing other features and components of the bottom track 66 and the top track 70. Alignment of the rear access doors 50*a* and 50*b* within different, locations along the bottom track 66 and the top track 70 is also shown. The internal support channels 18*a*-18*n* are not shown for the purpose of brevity and clarity. The bottom track 66, which can be of continuous nature or which can be a plurality of like aligned bottom tracks 66, includes a horizontally oriented panel 66*a*, a vertically oriented panel 66*b* extending downwardly from one end of the horizontally oriented panel 66*a* which suitably secures to the back panel 28, and a vertically oriented lip panel 66*c* extending upwardly from the other end of the horizontally oriented panel 66*a*. Correspondingly, the top track 70, which can be of continuous nature or which can be a plurality of like aligned top tracks 70, includes a horizontally oriented panel 70*a*, a vertically oriented panel 70*b* extending upwardly from one end of the horizontally oriented panel 70*a* which suitably secures to the back panel 28, and a vertically oriented lip panel 70*c* extending downwardly from the other end of the horizontally oriented panel 70*a*. The rear access door 50*a*, as well as the remaining rear access doors 50*b*-50*n*, have other features and components as now described, preferably having a one-piece structure including a rearwardly located back panel 51*a*, an end panel 51*b* (FIG. 8), an end panel 51*c*, a bottom panel 51*d*, a top panel 51*e*, and an open front panel 51*f*. Each of rear access doors 50*a*-50*n* includes a plurality of lock mechanisms 98*a*-98*n* having engagement bars 99 shown in various rotational orientations which are rotatable by the other components of the lock mechanisms 98*a*-98*n* to lockingly engage or unlockingly disengage a plurality of slots 49*a*-49*n* common to the opposed sets of mounting rails 46*a*-46*n* and 48*a*-48*n*, respectively. The engagement bars 99 of the rear access door 50*a* are disengaged from all of the slots 49*a*-49*n* of the mounting rails 46*a* and 48*a*, thus allowing the rearward positioning of the rear access door 50*a* to the rear region of the opposed and engaging bottom track 66 and top track 70. The engagement bars 99 of the rear access door 50*b* are shown engaged within the slots 49*a*-49*n* of the mounting rail 48*b* and of the mounting rail 46*b* (not shown), thus securing the forward positioning of the rear access door 50*b* to the forward region of the opposed and engaging bottom track 66 and top track 70. Such engagement forces the front panel 51*f* against the seal 52*b* surrounding the access opening 30*b*.

Mode of Operation of the Embodiment Illustrated in FIGS. 1-11B

FIGS. 9 and 11 best illustrate the mode of operation of the instant invention with understood reference to FIGS. 1-8 and 10 all other figures. Access to the interior regions of the electronic sign to service or replace items, such as, but not limited to, electronic display panels 32*a*-32*n*, a plurality of LED modules 59, and the like, is accomplished by actuating the lock mechanisms 98*a*-98*n* of the desired rear access doors 50*a*-50*n*, such as rear access door 50*a*, for example, to rotatingly disengage each of the engagement bars 99 from intimate engagement of the slots 49*a*-49*n* of the mounting rails 46*a* and 48*a* for subsequent full disengagement of the rear access door 50*a* from the seal 52*a* and the access opening 30*a*. The rear access door 50*a* is then manually maneuvered rearwardly, utilizing the horizontally oriented panel 66*a* of the bottom track 66 as a slide support, to be positioned at the rearward portion of the bottom track 66 and the top track 70 until contacting or coming in close proximity to the vertically oriented lip 66*c* and the vertically oriented lip 70*c* thereof to await supported sliding lateral positioning along the horizontally oriented panel 66*a* of the bottom track 66, as well as along the horizontally oriented panel 70*a* of the top track 70. To slidingly position the rear access door 50*a*, as shown in FIG. 9, the hinged flap 96*a* of the rear access door 50*a* can be rotated to the vertical position, as shown. The hinged flap 96*b* of the rear access door 50*b* must be raised to the vertical position and the hinged flap 94*a* of the bottom retainer 92*a* must be raised to the vertical position to allow free and clear unobstructed lateral passage of the lower portion of the rear access door 50*a* along the bottom track 66 in cooperation with free passage within the unobstructed top track 70. The rear access door 50*a* or several other rear access doors 50*b*-50*n* can be positioned laterally in the same manner and fashion along the bottom track 66 and the top track 70 to allow access at multiple locations depending upon the available space therealong. The illustrated rear access door 50*a* can be laterally positioned along the bottom track 66 and the top track 70 until positioning is limited by contacting the vertically aligned stop bars 84 and 86 at one end of the top track 70 and the bottom track 66, respectively, or in the other direction, until lateral positioning is limited by contacting the angled stop bars 76 and 82 of the top track 70 and the bottom track 66, respectively. If total removal of the rear access doors 50*a*-50*n* is required, the angled stop bars 76 and 82 at the ends of the elongated top and bottom retainers 72 and 78, respectively, can be removed to open one end of the top track 70 and the bottom track 66. Conversely, the rear access doors 50*a*-50*n* can be loaded into the open top track 70 and the bottom track 66 followed by reinstallation of the angled stop bars 76 and 82 with the top track 70 and the bottom track 66.

When sealing of the rear access doors 50*a*-50*n*, such as rear access door 50*a*, for example, the rear access door 50*a* is positioned along the rearward region of the top track 70 and the bottom track 66 into spaced alignment with the access opening 30*a*. The rear access door 50*a* is then manually urged forwardly and guided and aligned by vertical surfaces of the top retainer 90*a*, the bottom retainer 92*a*, the retainer surface 74, and the retainer surface 80, as previously described in detail, to cause the front panel 51*f* of the rear access door 50*a* to engage the seal 52*a* and to simultaneously align the engagement bars 99 of the lock mechanisms 98*a*-98*n* with the slots 49*a*-49*n* of the mounting rails 46*a* and 48*a*. The lock mechanisms 98*a*-98*n* are then actuated to forcibly engage the slots 49*a*-49*n* of the mounting rails 46*a* and 48*a*, thereby forcing sealed contact of the front panel 51*f* of the rear access door 50*a* with the seal 52*a*.

Figure 12:
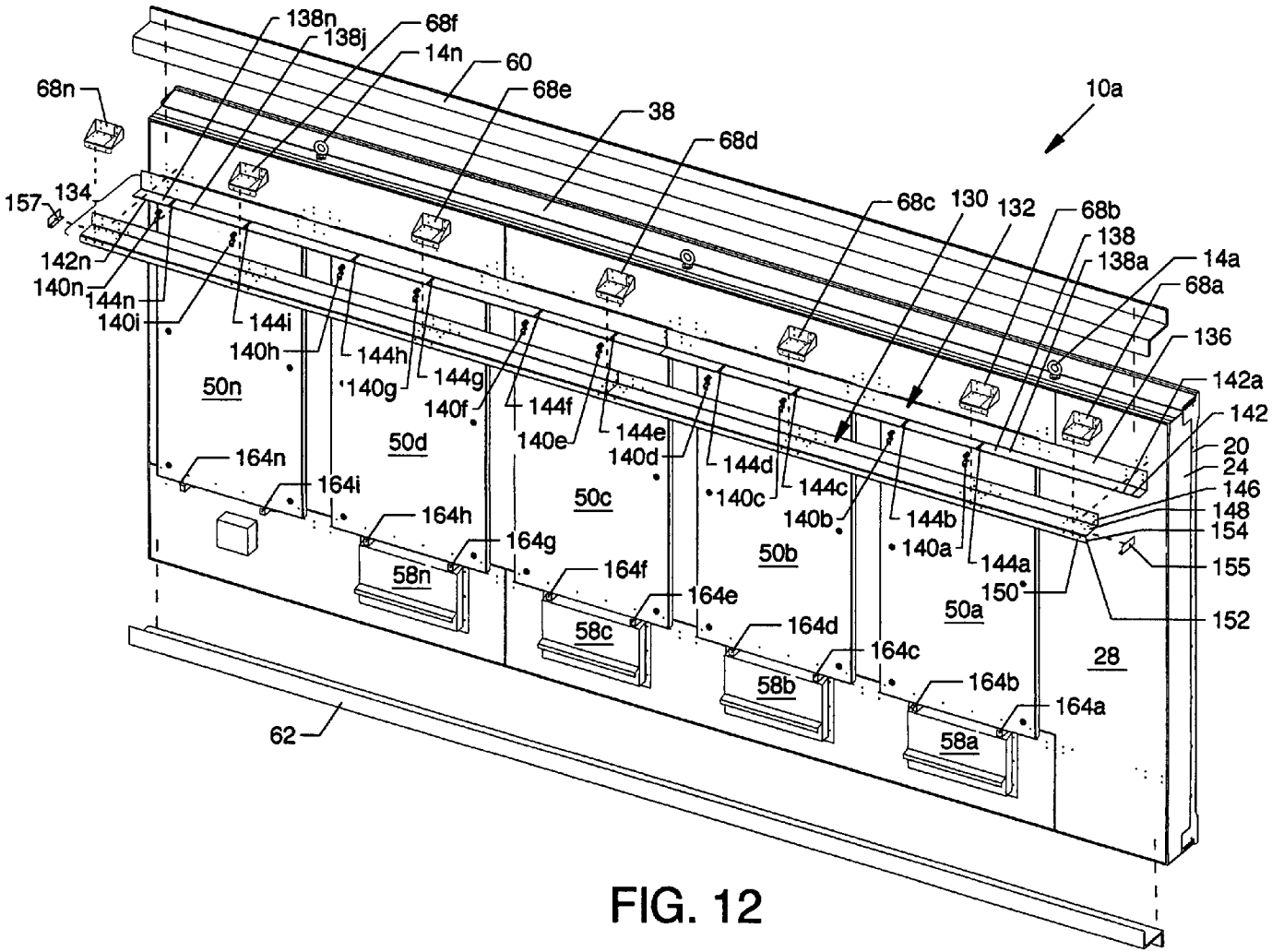
FIG. 12, an alternative embodiment, is a partially exploded upper aspect rear isometric view of an electronic sign with multiple direction positionable rear access doors.
Figure 13:
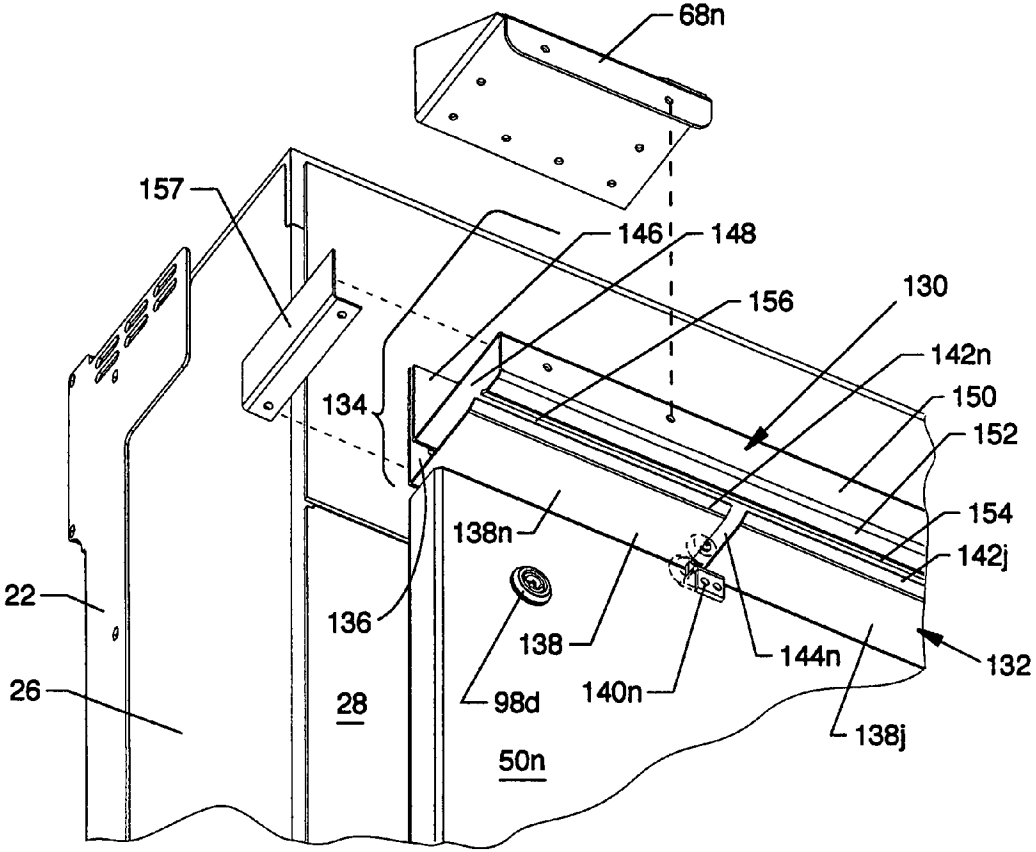
FIG. 13 is a segment view of the alternative embodiment along line 13-13 of FIG. 16.
Figure 14:
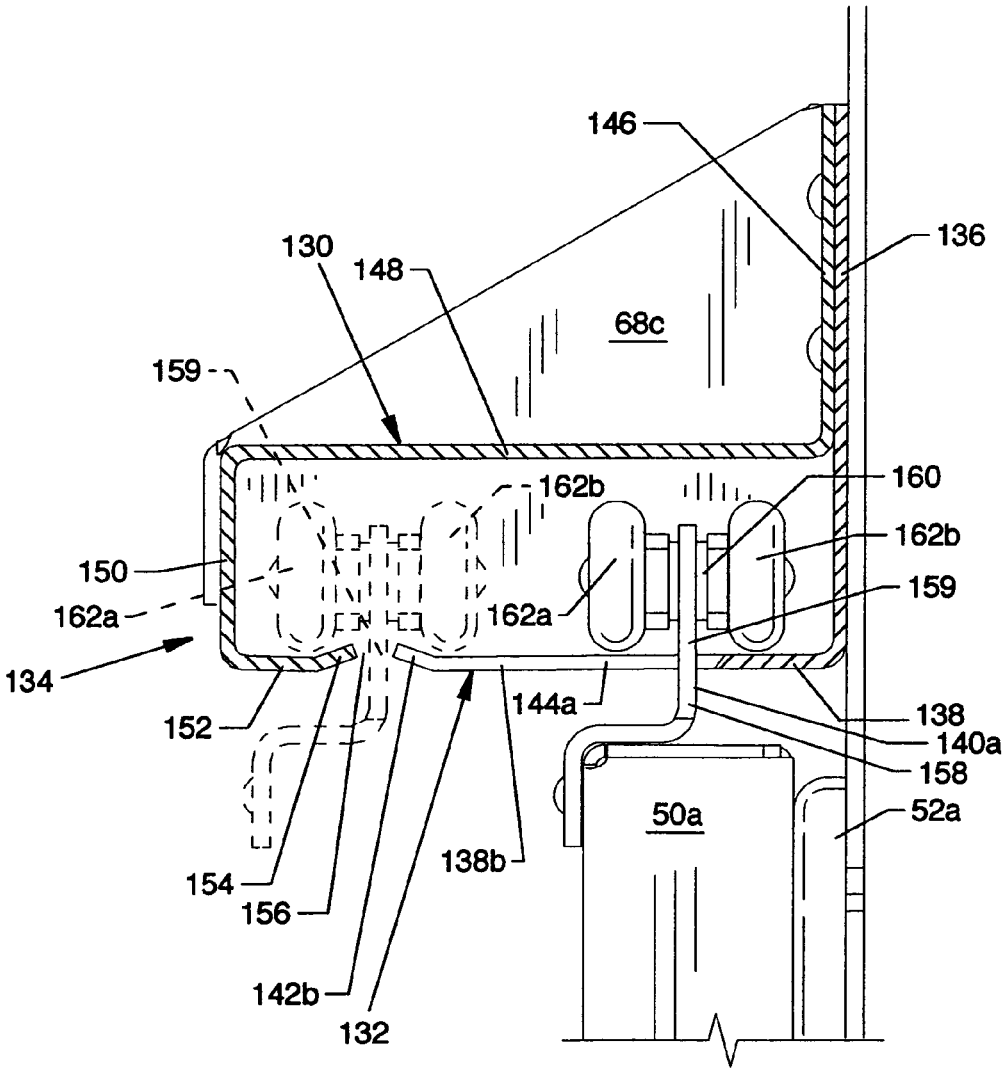
FIG. 14 is a cross section view of the roller support track along line 14-14 of FIG. 16, as well as a non-cross section view of other closely associated components.
Figure 15:
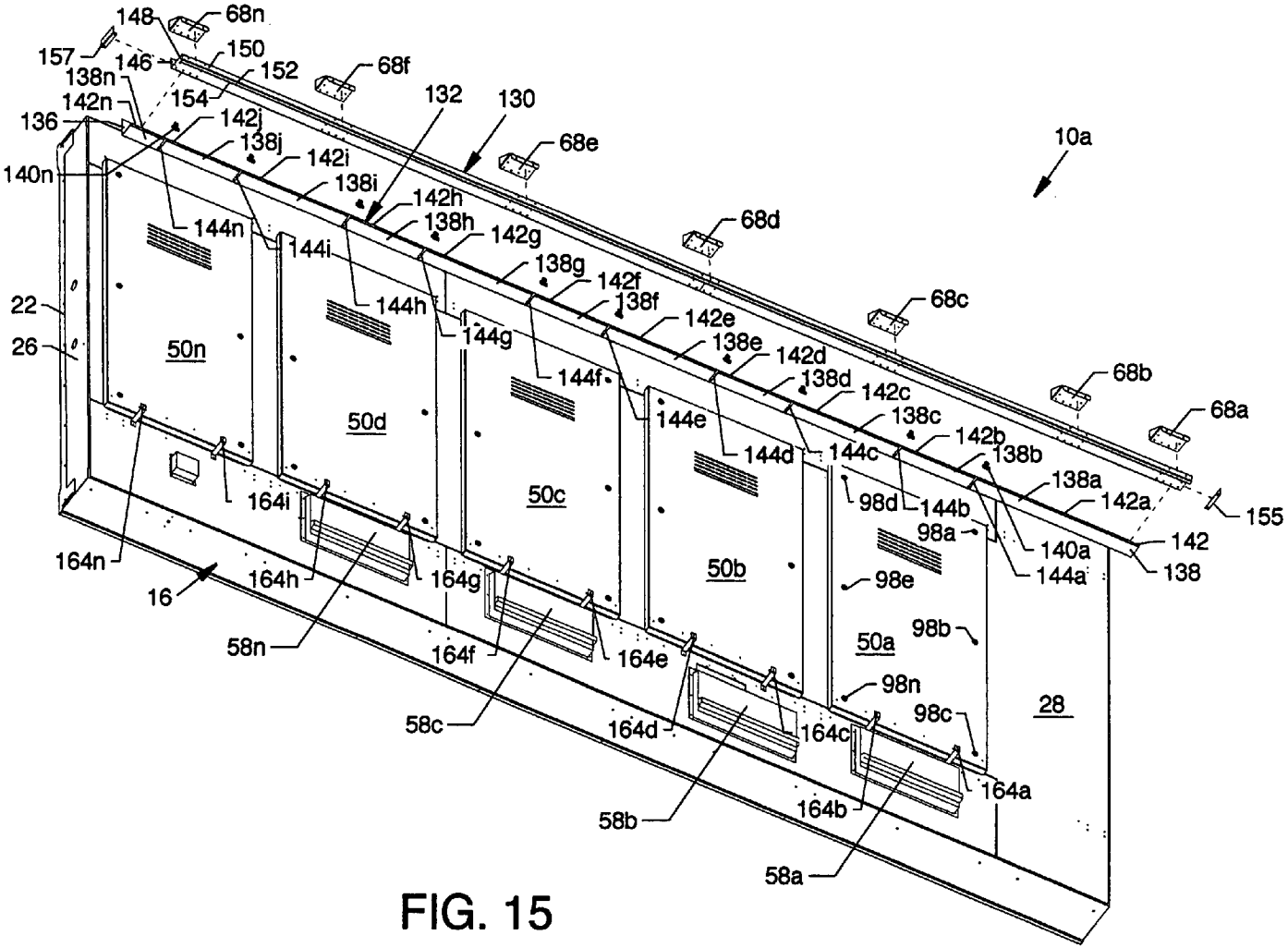
FIG. 15 is a partially exploded lower aspect rear isometric view of the alternative embodiment electronic sign with multiple direction positionable rear access doors excluding Z-channels.
Figure 16:
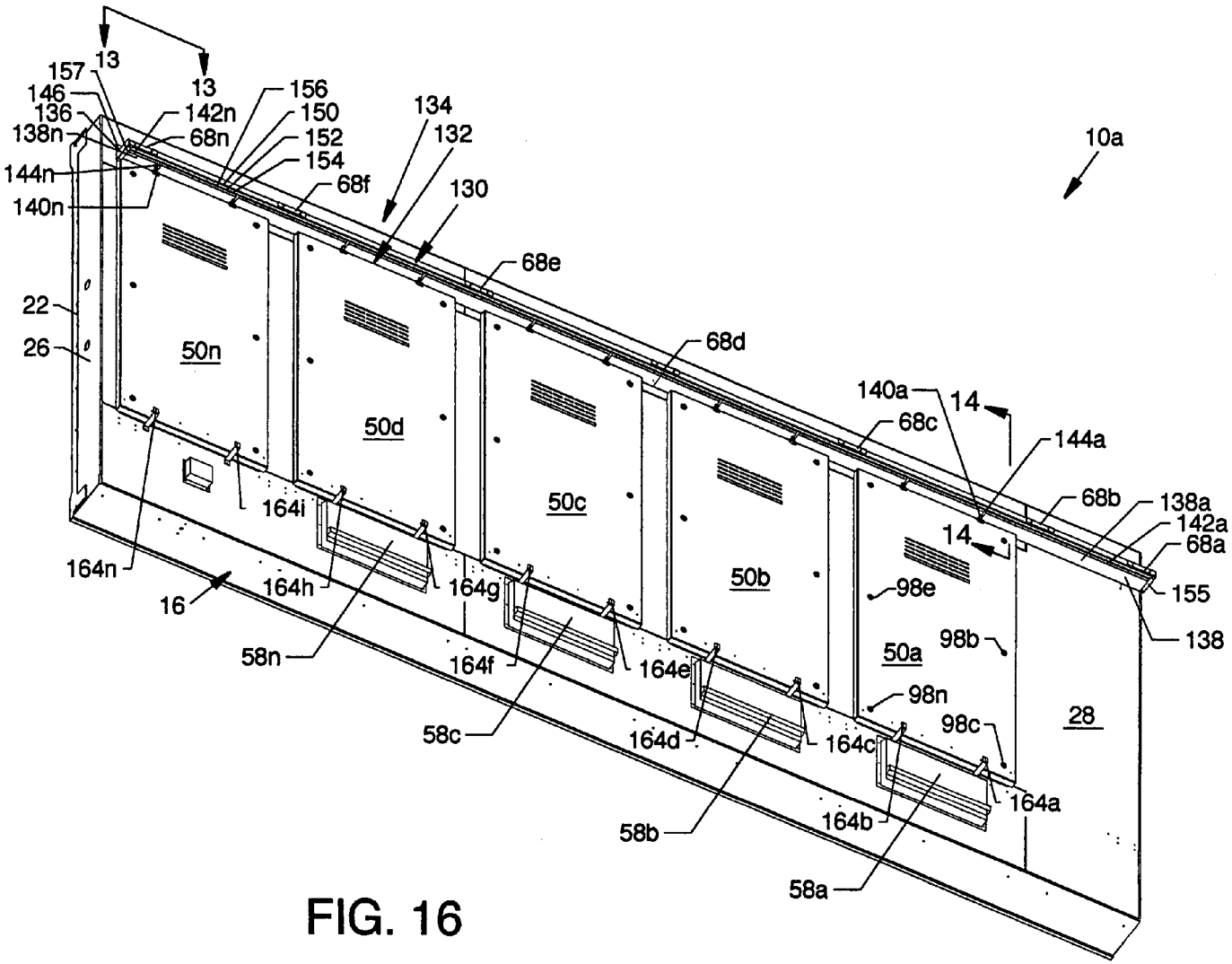
FIG. 16 is an assembled lower aspect rear isometric view of the components of FIG. 15.

FIG. 12, an alternative embodiment, is a partially exploded upper aspect rear isometric view of an electronic sign with multiple direction positionable rear access doors 10*a*, FIG. 13 is a segment view of the alternative embodiment along line 13-13 of FIG. 16, FIG. 14 is a cross section view of the roller support track 134 along line 14-14 of FIG. 16, as well as a non-cross section view of other closely associated components, FIG. 15 is a partially exploded lower aspect rear isometric view of the electronic sign with multiple direction positionable rear access doors 10*a* excluding Z-channels 60 and 62, and FIG. 16 is an assembled lower aspect rear isometric view of the electronic sign with multiple direction positionable doors 10*a* of FIG. 15. FIGS. 12-16 adhere for the most to the general teachings and structure of the first embodiment, but involve variations from the first embodiment in terms of additions or deletions of features and structures. Some features or quantities of structures in these figures or following figures may not be shown for the purpose of brevity, clarity and conciseness. The plurality of support brackets 68*a*-68*n* secure by fasteners to the back panel 28 through a top track roller support 130 and a through a multiple slot roller support 132, the latter two of which preferably are of channel construction and which comprise and form a roller support track 134, the structure of which is best understood by reference to FIGS. 13 and 14. In the alternative, the roller support track 134 can be a one-piece extruded structure unitarily incorporating the described attributes of the components comprising the roller support track 134. The roller support track 134 is incorporated for the suspended transporting support of the rear access doors 50*a*-50*n* at various times. Attachment of the roller support track 134 to the back panel 28 as just described and the use of and the attachment of the roller support track 134 to the robustly fashioned support brackets 68*a*-68*n* offers a strong and sturdy suspended support for one or more of the rear access doors 50*a*-50*n*, as required in order that personnel can easily and readily effect door movement.

With reference to FIGS. 12, 13 and 14, the structure of the roller support track 134, the components comprising such, and other associated components are now described. The multiple slot roller support 132 includes a vertically oriented front panel 136 and a horizontally oriented segmented mid-panel 138 extending perpendicularly from the front panel 136. The segmented mid-panel 138 is geometrically configured and structured to accommodate portions of a plurality of rollered trucks 140*a*-140*n* for suspended and transported support of the rear access doors 50*a*-50*n*. An angled interrupted panel 142 extends rearwardly and upwardly from the main body of the segmented mid-panel 138 and includes a plurality of angled panel segments 142*a*-142*n* delineated by a plurality of longitudinal transfer slots 144*a*-144*n* extending through and along the angled interrupted panel 142, as well as extending through a greater portion of the main body of the segmented mid-panel 138, to terminate prior to intersecting the front panel 136 to delineate mid-panel segments 138*a*-138*n*. The top track roller support 130 is also geometrically configured and structured to accommodate portions of a plurality of rollered trucks 140*a*-140*n* for suspended and transported support of the rear access doors 50*a*-50*n* and includes a vertically oriented front panel 146, a horizontally oriented mid-panel 148 extending perpendicularly from the front panel 146, a rear panel 150 extending perpendicularly and downwardly from the mid-panel 148, a horizontally oriented bottom panel 152 extending perpendicularly and forwardly from the rear panel 150, and an angled panel 154 extending upwardly and forwardly from the bottom panel 152. Stop bars 155 and 157 align and secure to the opposite ends of the roller support track 134 to limit the lateral movement of the rear access doors 50*a*-50*n* along the roller support track 134. An elongated lateral transfer slot 156 extends along the bottom region of the roller support track 134 being comprised by the structure of the top track roller support 130 and the multiple slot roller support 132. More explicitly, the exposed edge of the angled panel 154 of the top track roller support 130 forms one edge of the lateral transfer slot 156, and the exposed edges of the angled panel segments 142*a*-142*n* form an opposed but segmented or interrupted edge opposing the exposed edge of the angled panel 154. The support brackets 64*a*-64*n*, the angled stop bar 82, the stop bar 86, the hinged flap 88, the bottom retainers 92*a*-92*n*, the hinged flaps 94*a*-94*n*, and the hinged flaps 96*a*-96*n* of the first embodiment are replaced by a plurality of appropriately spaced retainer brackets 164*a*-164*n* secured at the lower region of the back panel 28 which limit rearward movement of the bottoms of the rear access doors 50*a*-50*n* and which stabilize movement of the rear access doors 50*a*-50*n* during lateral movement.

Rollered truck 140*a* (FIG. 14) of the plurality of rollered trucks 140*a*-140*n* is shown in full view with respect to a cross section view of the roller support track 134, wherein the rear access door 50*a* is held in intimate engaged contact with the seal 52*a* by the use of the lock mechanisms 98*a*-98*n*, as previously described. The rollered truck 140*a* includes a multiple angle bracket 158 having a vertical portion 159. The lower end of the bracket 158 secures to the top region of the rear access door 50*a*, such as by the use of fasteners or by other suitable methods. An axle assembly 160 secures through the upper end of the bracket 158 and includes oppositely mounted rollers 162*a* and 162*b* of robust sturdy construction which can accommodate side loads along the axis thereof, as well as vertical loads which can be caused by the operation of the rear access door 50*a*. The rollered truck 140*a* is shown partially supported by the segmented mid-panel 138, and more specifically, the roller 162*b* is supported by the portion of the segmented panel 138 between the end of the longitudinal transfer slot 144*a* and the adjacent front panel 136. The other roller 162*a* is shown unsupported and in alignment just over, but in close proximity to, the longitudinal transfer slot 144*a*. Operation of the roller truck 140*a* is described later in detail. It is to be understood that rollered trucks 140*b*-140*n* are identical to rollered truck 140*a*.

Figure 17:
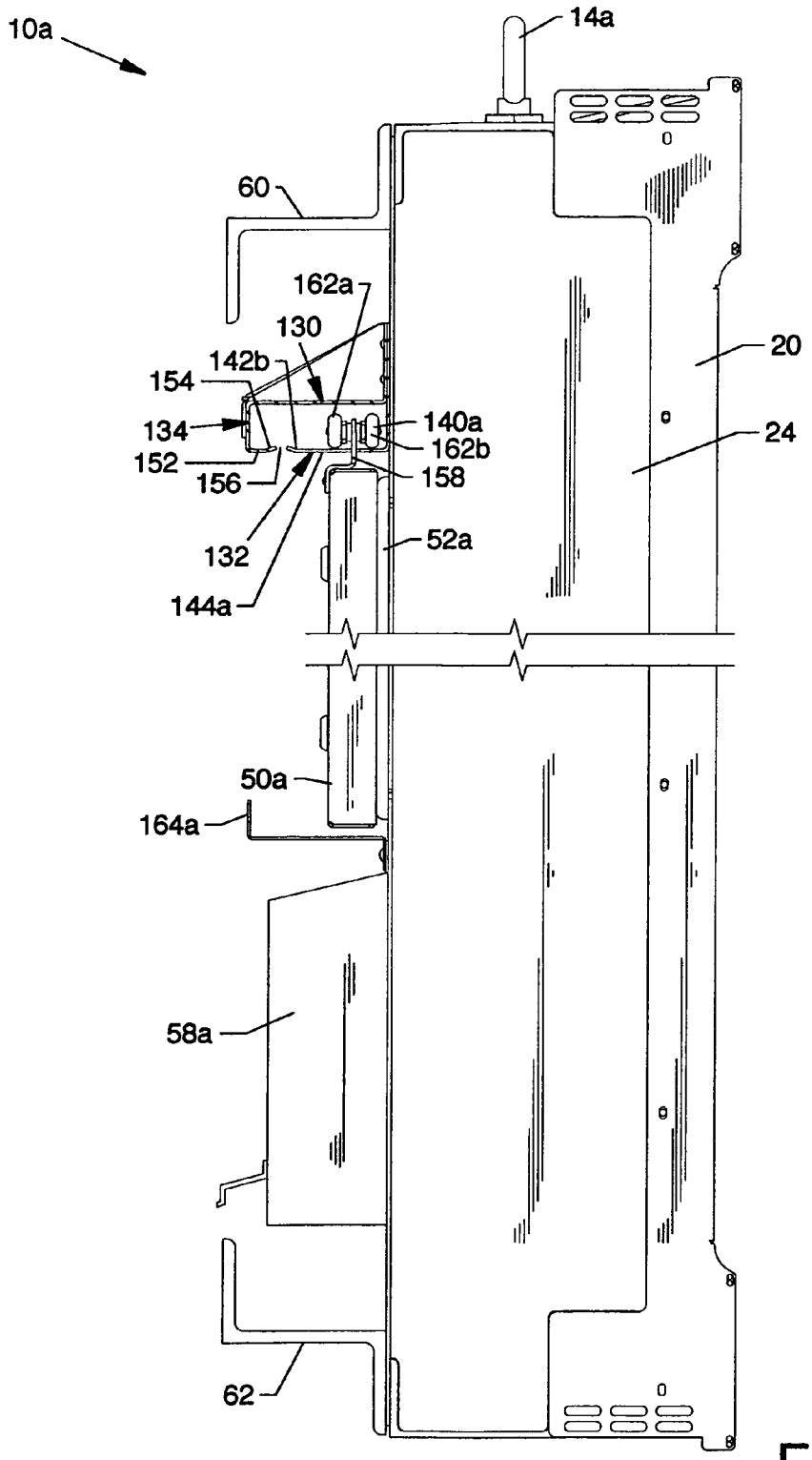
FIG. 17 is a foreshortened end view of the electronic sign with multiple direction positionable rear access doors with a stop bar removed and includes a cross section view of the roller support track through a longitudinal transfer slot.

FIG. 17 is a foreshortened end view of the electronic sign with multiple direction positionable rear access doors 10*a* with the stop bar 155 removed and includes a cross section view of the roller support track 134 through the longitudinal transfer slot 144*a*.

Figure 18:
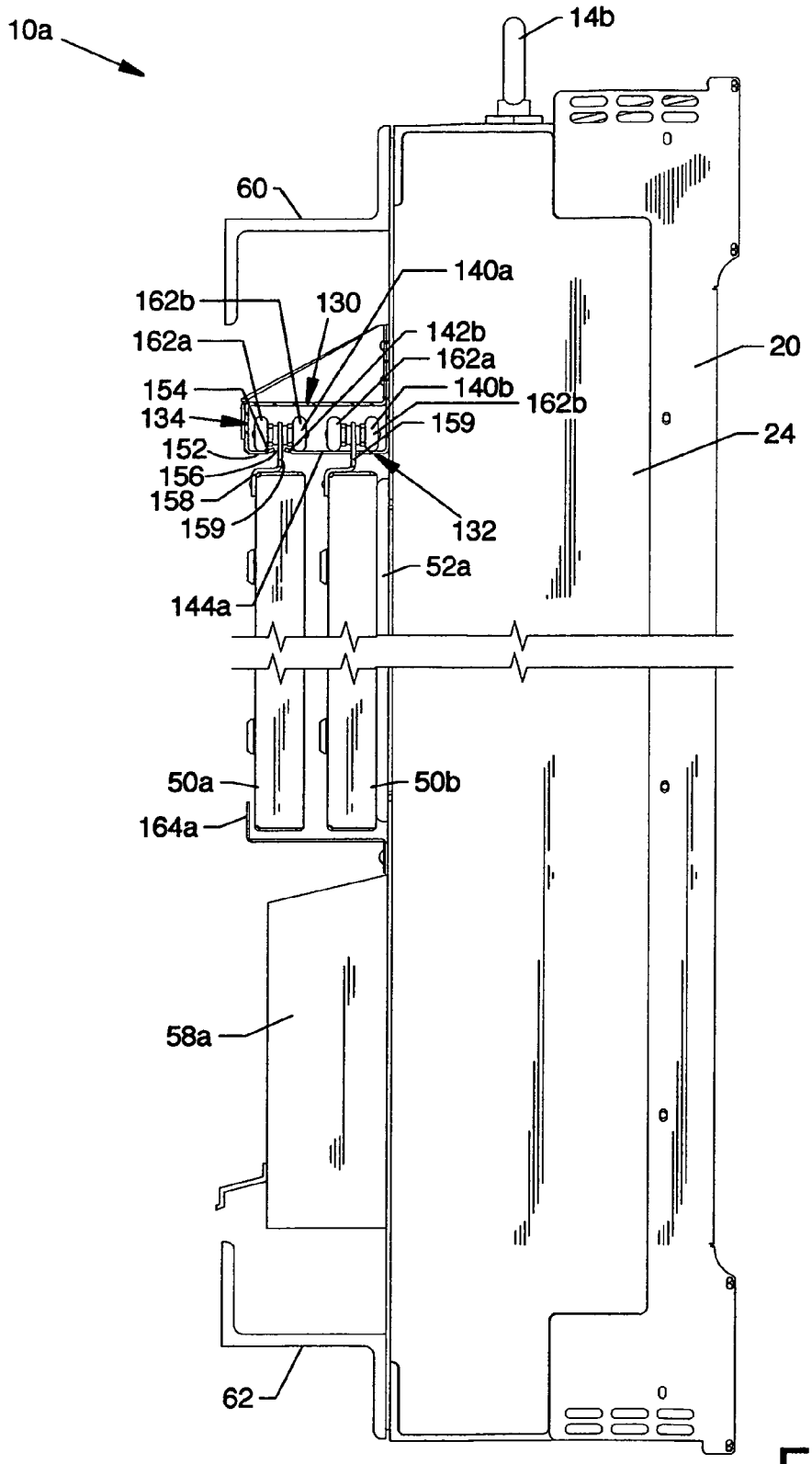
FIG. 18 is a view like FIG. 17 where a rear access door has been disengaged from a seal for lateral transport along the roller support track; and, FIG. 19 is a lower aspect rear isometric view of one end of the alternative embodiment electronic sign with multiple direction positionable rear access doors where a rear access door has been disengaged from a seal for transported movement along the roller support track.

FIG. 18 is a view like FIG. 17 where the rear access door 50*a* has been disengaged from the seal 52*a* for transport along the roller support track 134.

Figure 19:
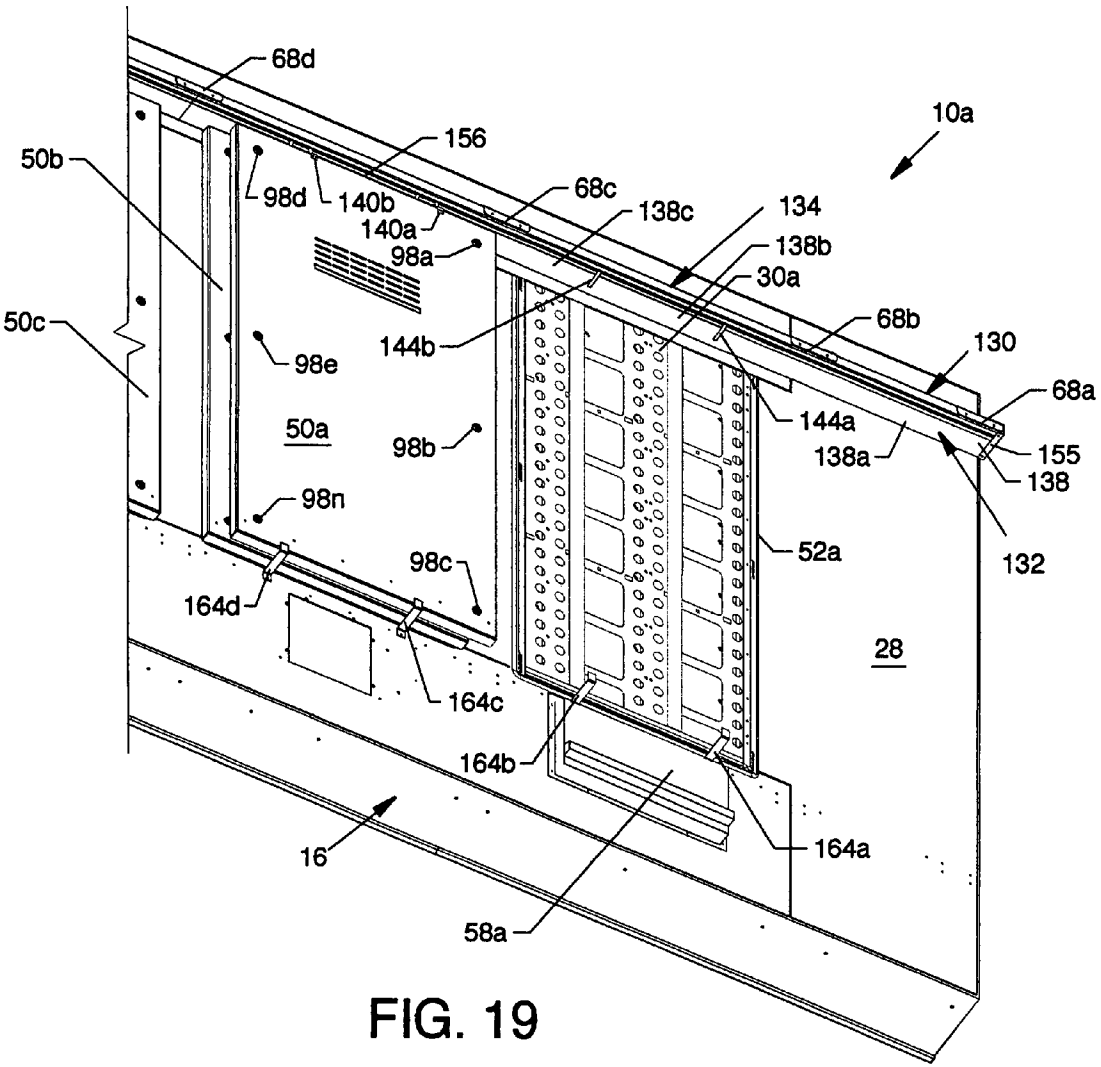

FIG. 19 is a rear lower aspect isometric view of one end of the electronic sign with multiple direction positionable rear access doors 10*a* where the rear access door 50*a* has been disengaged from the seal 52*a* and transported along the roller support track 134.

Mode of Operation of the Alternative Embodiment

FIGS. 17, 18 and 19 best illustrate the mode of operation of the alternative embodiment with understood reference to all other pertinent figures. Normally (when closed) the rear access door 50*a* is supported by the rollered trucks 140*a* and 140*b* (FIG. 19) in combination with the lock mechanisms 98*a*-98*n* which are engaged with the slots 49*a*-49*n* of the appropriate mounting rails 46*a* and 48*a*. Access to the interior regions of the sign structure to service or replace items, such as, but not limited to, electronic display panels 32*a*-32*n*, a plurality of LED modules 59, and the like, is accomplished by actuating the lock mechanisms 98*a*-98*n* of the desired rear access doors 50*a*-50*n*, such as rear access door 50*a*, for example and illustration, to rotatingly disengage each of the engagement bars 99 from intimate engagement with the slots 49*a*-49*n* of the mounting rails 46*a* and 48*a* for subsequent full disengagement of the rear access door 50*a* from the seal 52*a* and the access opening 30*a*.

Subsequent to disengagement of the engagement bars 99 of the lock mechanisms 98*a*-98*n* with the slots 49*a*-49*n*, the rear access door 50*a* is then supported only by the rollered trucks 140*a* and 140*b*. The rear access door 50*a* is then manually maneuvered rearwardly utilizing the longitudinal transfer slots 144*a* and 144*b* of the roller support track 134, the interaction of the rollered truck 140*a* with the longitudinal transfer slot 144*a* of the roller support track 134 being next described. The interaction of the rollered truck 140*b* with the longitudinal transfer slot 144*b* of the roller support track 134 is similar and not described for the purpose of brevity. At first, the roller 162*b*, which awaits rearward longitudinal transition, is supported by the portion of the segmented mid-panel 138 between the forward end of the longitudinal transfer slot 144*a* and the front panel 136 of the multiple slot roller support 132; and the roller 162*a*, which also awaits rearward longitudinal transition, is in close proximity to portions of the mid-panel segments 138*b* and 138*a* which form the longitudinal transfer slot 144*a* of the multiple slot roller support 132. The vertical portion 159 of the bracket 158, which also awaits rearward longitudinal transition, aligns within the longitudinal transfer slot 144*a*. When urged rearwardly, both rollers 162*a* and 162*b* come in fully supported rearward sliding contact with the longer edges of the longitudinal transfer slot 144*a*, and thence with further urging, the rollers 162*a* and 162*b* are positionally centered about the lateral transfer slot 156, such as shown in FIG. 18 and as shown in dashed lines in FIG. 14. At this time, the roller 162*a* is supported by the bottom panel 152 of the top track roller support 130, the roller 162*b* is in close proximity to the panels 138*b* and 138*a* of the multiple slot roller support 132, and the vertical portion 159 of the bracket 158 aligns within the lateral transfer slot 156. Lateral urging of the rear access door 50*a* toward the rear access door 50*b* along the roller support track 134 causes the roller 162*b* to be fully supported by the mid-panel segment 138*b* in addition to the continued support of the roller 162*a* by the bottom panel 152. The cant of the angled panels 154 and the angled panel segments 142*a*-142*n* serve to act as an interacting center guide to the rollers 162*a* and 162*b* of the rollered trucks 140*a* and 140*b*, whereby the vertical portion 159 of the bracket 158 is urged and forced to align within the lateral transfer slot 156. Such alignment maintains the vertical portion 159 of the bracket 158 within the lateral transfer slot 156 to prevent frictional annoyances involved during lateral urging of the rear access door 50*a*. As the rollered trucks 140*a* and 140*b* negotiate the roller support track 134 and encounter the next longitudinal transfer slot 144*b*, smooth passage over the longitudinal transfer slot 144*b* is ensured, whereby the roller 162*a* is still in full supportive uninterrupted contact with the bottom panel 152, while the roller 162*b* transits the longitudinal transfer slot 144*b*. The lateral transfer slot 156 in direct association with the roller 162*a* serves the further purpose of preventing the vertical portion of the bracket 158 from inadvertently entering and colliding with the structure of the next longitudinal transfer slot, such as longitudinal transfer slot 144*b*. The rear access door 50*a* or several other rear access doors 50*b*-50*n* can be positioned laterally in the same manner and fashion along the roller support track 134 to allow access at multiple locations depending upon the available space therealong. The illustrated rear access door 50*a* can be laterally positioned along the roller support track 134 until positioning is limited by contacting the vertically aligned stop bars 155 and 157 at opposite ends of the roller support track 134. If total removal of the rear access doors 50*a*-50*n* is required, access to the roller support track 134 can be made available by temporary removal of the stop bars 155 and 157. Conversely, the rear access doors 50*a*-50*n* can be loaded into the roller support track 134 followed by reinstallation of the stop bars 155 and 157.

When sealing of the rear access doors 50*a*-50*n* is required, such as a previously repositioned rear access door 50*a*, for example, the rear access door 50*a* is positioned along the rearward region of the roller support track 134 into spaced alignment with the access opening 30*a* utilizing the longitudinal transfer slots 144*a* and 144*b* as guides for accommodation of the vertical portions 159 of the brackets 158 of the roller trucks 140*a* and 140*b*. The rear access door 50*a* is then manually urged forwardly and guided and aligned using the structure as just described to cause the front panel 51*f* of the rear access door 50*a* to engage the seal 52*a* and to simultaneously align the engagement bars 99 of the lock mechanisms 98*a*-98*n* with the slots 49*a*-49*n* of the mounting rails 46*a* and

48*a*. The lock mechanisms 98*a*-98*n* are then actuated to forcibly engage the slots 49*a*-49*n* of the mounting rails 46*a* and 48*a*, thereby forcing sealed contact of the front panel 51*f* of the rear access door 50*a* with the seal 52*a*.

Various modifications can be made to the present invention without departing from the apparent scope thereof. Such modifications can be the use of rollers, small wheels, Teflon® panels, or other friction reducing components and the like placed on either or both of the bottom panel 51*d* of the rear access doors 50*a*-50*n* or on the upper surface of the horizontally oriented panel 66*a* of the bottom track 66 for support of the rear access doors 50*a*-50*n*. Another modification can be the use of a suspension track and roller system connecting the upper region of the rear access doors 50*a*-50*n* to the upper region of the back panel 28 or to the top track 70.

Electronic Sign with Multiple Direction Positionable Rear Access Doors

PARTS LIST

| | |
|---|---|
| 10 | electronic sign with multiple direction positionable rear access doors |
| 10a | electronic sign with multiple direction positionable rear access doors |
| 12 | geometrically configured top support channel |
| 14a-n | lifting lugs |
| 16 | geometrically configured bottom support channel |
| 18a-n | internal support channels |
| 20 | left front end plate |
| 22 | right front end plate |
| 24 | left back end plate |
| 26 | right back end plate |
| 28 | back panel |
| 30a-n | access openings |
| 32a-n | electronic display panels |
| 34 | left face panel |
| 36 | right face panel |
| 38 | top shroud |
| 40 | bottom shroud |
| 42a-n | mounting plates |
| 44a-n | mounting plates |
| 46a-n | mounting rails |
| 48a-n | mounting rails |
| 49a-n | slots |
| 50a-n | rear access doors |
| 51a | back panel |
| 51b | end panel |
| 51c | end panel |
| 51d | bottom panel |
| 51e | top panel |
| 51f | front panel |
| 52a-n | seals |
| 54a-n | vent openings |
| 56a-n | vents |
| 58a-n | vent covers |
| 59 | LED module |
| 60 | Z-channel |
| 62 | Z-channel |
| 64a-n | support brackets |
| 66 | bottom track |
| 66a | horizontally oriented panel |
| 66b | vertically oriented panel |
| 66c | vertically oriented lip panel |
| 68a-n | support brackets |
| 70 | top track |
| 70a | horizontally oriented panel |
| 70b | vertically oriented panel |
| 70c | vertically oriented lip panel |
| 72 | elongated top retainer |
| 74 | retainer surface |
| 76 | angled stop bar |
| 78 | elongated bottom retainer |
| 80 | retainer surface |

-continued

PARTS LIST

| | |
|---|---|
| 82 | angled stop bar |
| 84 | stop bar |
| 86 | stop bar |
| 88 | hinged flap |
| 90a-n | top retainers |
| 92a-n | bottom retainers |
| 94a-n | hinged flaps |
| 96a-n | hinged flaps |
| 98a-n | lock mechanisms |
| 99 | engagement bar |
| 100 | arcuate lip |
| 102 | pivot bar |
| 104 | arcuate lip |
| 106 | arcuate receptor |
| 108 | retainer bar |
| 110 | arcuate lip |
| 112 | slot |
| 114 | weatherstrip seal |
| 116 | weatherstrip seal |
| 118 | arcuate receptor |
| 120 | weatherstrip seal |
| 130 | top track roller support |
| 132 | multiple slot roller support |
| 134 | roller support track |
| 136 | front panel |
| 138 | segmented mid-panel |
| 138a-n | mid-panel segments |
| 140a-n | rollered trucks |
| 142 | angled interrupted panel |
| 142a-n | angled panel segments |
| 144a-n | longitudinal transfer slots |
| 146 | front panel |
| 148 | mid-panel |
| 150 | rear panel |
| 152 | bottom panel |
| 154 | angled panel |
| 155 | stop bar |
| 156 | lateral transfer slot |
| 157 | stop bar |
| 158 | bracket |
| 159 | vertical portion |
| 160 | axle assembly |
| 162a-b | rollers |
| 164a-n | retainer brackets |

The invention claimed is:

1. An electronic sign comprising:

a support structure, the support structure having a forward region and a rearward region;

a plurality of electronic display panels mounted to the forward region of the support structure for forward directed electronic display;

a back panel mounted to the rearward region of the support structure, the back panel having a plurality of access openings for accessing the electronic display panels of the plurality of electronic display panels;

at least one top track and at least one opposed bottom track associated with the plurality of access openings;

a plurality of multiple direction positionable rear access doors movably mounted between and positionable along the at least one top track and the at least one opposed bottom track; and a hinged flap adjacent the at least one bottom track.

2. The electronic sign of claim 1, further comprising:

a plurality of lock mechanisms located along and about the perimeters of the plurality of multiple direction positionable rear access doors;

a plurality of mounting rails; and, wherein a lock mechanism of the plurality of lock mechanisms engages a mounting rail of the plurality of mounting rails to secure a multiple direction positionable rear access door of the plurality of multiple direction positionable rear access doors against an access opening of the plurality of access openings.

3. The electronic sign of claim 2, further comprising:

a plurality of seals, each of the seals of the plurality of seals surrounding an access opening of the plurality of access openings in the back panel.

4. The electronic sign of claim 3, wherein seals of the plurality of seals seal the multiple direction positionable rear access doors to the back panel when the lock mechanisms secure the multiple direction positionable rear access doors against the access openings of the back panel.

5. The electronic sign of claim 1, wherein each electronic display panel includes an LED module.

6. The electronic sign of claim 1, further comprising:

vent openings at a lower region of the back panel for flowing cooling air.

7. The electronic sign of claim 1, further comprising:

vent openings in each multiple direction positionable rear access door for flowing cooling air.

8. The electronic sign of claim 1, wherein a thin profile is maintained between the support structure and the multiple direction positionable rear access doors.

9. The electronic sign of claim 1, wherein space rearward of the back panel is not required to accommodate swinging doors.

10. The electronic sign of claim 1, further comprising:

a geometrically configured top support channel and a geometrically configured bottom support channel.

11. The electronic sign of claim 10, wherein the geometrically configured top support channel and the geometrically configured bottom support channel are interconnected by a plurality of vertically aligned internal support channels.

12. The electronic sign of claim 11, wherein the back panel secures and extends between the geometrically configured top channel and the geometrically configured bottom channel.

13. The electronic sign of claim 1, wherein each access opening is characterized by having a first vertically oriented mounting plate and a second vertically oriented mounting plate opposed to the first vertically oriented mounting plate each accommodating a vertically oriented mounting rail for fastening the multiple direction positionable rear access doors.

14. The electronic sign of claim 13, wherein the access openings further include seals.

15. The electronic sign of claim 1, wherein the hinged flap may be rotatably deployed to protect the bottom track from dirt.

16. An electronic sign comprising:

a support structure having a front region and a rear region;

at least one LED module mounted to the support structure for front directed display;

a back panel mounted to the support structure, the back panel having at least one access opening arranged for maintaining the at least one LED module;

at least one track mounted rear access door slidably alignable to secure the at least one access opening and slidably movable to expose the at least one access opening for maintenance access; and a flap to protectively cover a portion of the track carrying the at least one track mounted rear access door.

17. The electronic sign of claim 16, wherein the at least one track mounted rear access door is horizontally slidable.

18. The electronic sign of claim 16, wherein the at least one track mounted rear access door secures to the at least one access opening when aligned therewith.

19. The electronic sign of claim 18, further comprising:

a seal interposed between the at least one track mounted rear access door and the at least one access opening when secured thereto.

20. The electronic sign of claim 19, wherein the at least one track mounted rear access door moves in a frontward direction to seal and secure the at least one access opening.

21. The electronic sign of claim 16, wherein the at least one track mounted rear access door slides in a horizontal direction to expose the at least one access opening.

22. The electronic sign of claim 16, wherein the at least one access opening is one of a plurality of access openings and the at least one track mounted rear access door is one of a plurality of track mounted rear access doors.

23. The electronic sign of claim 16, further comprising:

a vent in the at least one track mounted rear access door.

24. The electronic sign of claim 16, further comprising:

a vent below the at least one access opening.

25. The electronic sign of claim 16, further comprising:

a lock mechanism for locking the at least one track mounted rear access door in a secured relationship to the at least one access opening.

26. The electronic sign of claim 16, further comprising:

lifting lugs mounted to the support structure.

27. The electronic sign of claim 16, further comprising:

a stop bar structured to prevent the at least one track mounted rear access door from separating from the track.

28. A method of maintaining inner electronic components of an electronic sign comprising:

providing or receiving an electronic sign, including a support structure having a front region and a rear region, at least one LED module mounted to the support structure for front directed display, a back panel mounted to the support structure, the back panel having at least one access opening arranged for maintaining the at least one LED module, at least one track mounted rear access door slidably alignable to secure the at least one access opening and slidably movable to expose the at least one access opening for maintenance access, and a flap to protectively cover a portion of the track carrying the at least one track mounted rear access door, wherein the at least one track mounted rear access door is initially securing the at least one access opening;

unsecuring the at least one track mounted rear access door from the at least one access opening; and, slidably moving the unsecured at least one track mounted rear access door to expose the at least one access opening.

29. A method of maintaining inner electronic components of an electronic sign comprising:

providing or receiving an electronic sign, including a support structure having a front region and a rear region, at least one LED module mounted to the support structure for front directed display, a back panel mounted to the support structure, the back panel having at least one access opening arranged for maintaining the at least one LED module, at least one track mounted rear access door positionably movably alignable to secure the at least one access opening and positionably movable to expose the at least one access opening for maintenance access, and a flap to protectively cover a portion of the track carrying the at least one track mounted rear access door, wherein the at least one track mounted rear access door is initially securing the at least one access opening;

unsecuring the at least one track mounted rear access door from the at least one access opening; and, positionably moving the unsecured at least one track mounted rear access door to expose the at least one access opening.

30. The method of claim 29, further comprising:

servicing an interior component of the electronic sign through the exposed at least one access opening;

re-positioning the at least one track mounted rear access door to the at least one access opening; and, re-securing the at least one track mounted rear access door to the at least one access opening.

* * * * *